US007066772B2

(12) United States Patent
Takahashi

(10) Patent No.: US 7,066,772 B2
(45) Date of Patent: Jun. 27, 2006

(54) PLUG CONNECTOR

(75) Inventor: Kazuya Takahashi, Zama (JP)

(73) Assignee: Molex Incorporated, Lisle, IL (US)

( * ) Notice: Subject to any disclaimer, the term of this patent is extended or adjusted under 35 U.S.C. 154(b) by 146 days.

(21) Appl. No.: 10/476,079

(22) PCT Filed: Apr. 26, 2002

(86) PCT No.: PCT/US02/13337

§ 371 (c)(1),
(2), (4) Date: Oct. 24, 2003

(87) PCT Pub. No.: WO02/089259

PCT Pub. Date: Nov. 7, 2002

(65) Prior Publication Data

US 2005/0159047 A1 Jul. 21, 2005

(51) Int. Cl.
*H01R 13/514* (2006.01)

(52) U.S. Cl. ..... 439/731

(58) Field of Classification Search ..... 439/606, 439/736, 610, 731, 687, 696, 607
See application file for complete search history.

(56) References Cited

U.S. PATENT DOCUMENTS 3,945,708 A * 3/1976 Griffin ..... 439/337
4,579,404 A * 4/1986 Lockard ..... 439/92
4,582,384 A * 4/1986 Frantz et al. ..... 439/610
5,590,463 A * 1/1997 Feldman et al. ..... 29/844
5,879,196 A * 3/1999 Lee ..... 439/660
5,895,285 A * 4/1999 Okabe ..... 439/400
5,957,735 A * 9/1999 Shinchi ..... 439/874
6,210,231 B1 * 4/2001 Lai ..... 439/610
6,290,512 B1 * 9/2001 Mullen, Jr. ..... 439/106
6,485,333 B1 * 11/2002 Shinchi ..... 439/587
6,758,694 B1 * 7/2004 Liu ..... 439/606

* cited by examiner

*Primary Examiner*—Gary F. Paumen
(74) *Attorney, Agent, or Firm*—Robert J. Zeitler

(57) ABSTRACT

An improved plug connector including a housing and a housing cover engaged to each other in a length direction i.e. axial direction of the plug. Since the engaging portion is not provided in the width direction of the plug, the dimension in the width direction of the plug connector can be reduced. The improved plug collector may include a plurality of grooves for fitting terminals formed in the axial direction of the housing, the terminals being covered by portion of the housing cover such that the plurality of grooves are closed at each end. As such, the resin used to overmold the housing/housing cover is prevented from flowing to the front end of the plug connector by way of the grooves. The improved plug connector may also include a shield case having a clamp portion that is made eccentric from the axis core of the shield case. Since the clamp portion is not provided in the axial direction of the shield case, the clamp portion does not prevent and/or hinder the housing from being easily inserted into the shield case. As such, the integration of the housing with the shield case is simplified.

6 Claims, 26 Drawing Sheets

PLUG CONNECTOR

FIELD OF THE INVENTION

The present invention relates to an electrical connector, and more specifically, to an improved plug connector with a reduced width dimension, an improved method of preventing the overmold resin from causing contact failure and an improved shield case.

BACKGROUND OF THE INVENTION

Prior art plug connectors include a resin-molded handhold portion and a plug main body in which a portion thereof is projected from the handhold portion, the projected portion constituting a portion plugged into a mating connector.

The plug main body includes a housing, a plurality of terminals provided in the housing and connected to the cable, a housing cover covering at least a portion of the terminals and wires of the cable and a shield case for shielding the members. The plurality of terminals are fixed within a plurality, of grooves formed in the axial direction of the housing, and a cable is connected to the housing by soldering the wires to the terminals. The plug main body is formed by combining the housing cover and the shield case to the housing connected with the cable. The handhold portion is formed by overmolding the plug main body with a resin.

Although attachment of the housing cover to the housing is carried out by an engaging portion for engaging the two members, the engaging portion is formed in a width direction of the plug and therefore, the engaging portion constitutes a factor for increasing a width dimension. Furthermore, when the plug main body is overmolded, the resin can flow to the front end of the plug by way of the plurality of grooves of the housing fitted with the terminals. As a result, there is a concern of causing contact failure between the plug and the mating connector.

Although, the terminals may be embedded in the housing by insert molding or the grooves are closed by premolding as a countermeasure against leakage of the resin, these methods result in an increase in cost and/or the molding may become unstable.

Further, the cable cover is peeled off for soldering the core wires to the terminals. A knitted shield and a drain wire of the cable are turned back, and a copper foil tape ("copper foil portion") is wrapped around the turned-back members. The cable is clamped to the connector such that the copper foil tape is not loosened. The clamping is carried out by, for example, a portion of the shield case in the form of enabling the clamping of the cable. Therefore, the corresponding portion of the shield case is referred to as clamp portion.

Generally, when the shield case is attached to the housing, after the housing cover is attached to the housing, the shield case is fitted to the housing from the front end portion side of the housing along the longitudinal direction of the shield case. The dimension of the maximum width portion of the housing cover is larger than that of the copper foil portion and the housing cover is situated at the front end side of the cable.

When the shield case is fitted to the housing, the width dimension of the portion of the shield case holding the housing cover is larger than the clamp portion clamping the copper foil portion. The clamp portion is located at the rear end side of the shield case comparing to the portion holding the housing cover. Also the clamp portion has the clamp pieces made in a U shape cross section opening upwardly.

In this case, as stated above, since the dimension of the width of the clamp portion is smaller than that of the width of the housing cover, when the shield case is attached to the housing from the direction of the rear end side of the shield case, since the clamp portion, especially clamp piece having the dimension which is smaller than that of the housing cover conflicts with the housing cover, it is difficult to attach the shield case to the housing easily.

Therefore, when the shield case is introduced into the housing, there is a concern that the front end of the clamp portion constitutes a hindrance to mating the housing to the shield case. Therefore, it becomes difficult to integrate the housing to the shield case.

In addition, conventionally, there is proposed a shield case comprising two parts or more as means for shielding the housing. That is, the shield case includes a housing shield portion to shield the housing and a cover shield portion to shield the housing cover. In this instance, increased time and labor are required for control and integration of the two shield parts.

SUMMARY OF THE INVENTION

An object of the present invention, therefore, is to provide a new and improved electrical connector that overcomes the problems noted in the prior art.

Another object of the present invention is to reduce at least a dimension in a width direction of a plug connector.

Another object of the present invention is to prevent contact failure between the plug and its mating connector.

Still another object of the present invention is to simplify operation of integrating the connector housing with the connector shield case.

In an embodiment of the present invention, a housing and a housing cover are engaged to each other in a length direction i.e. axial direction of the plug. As such, the housing and the housing cover are not engaged in the width direction of the plug. Since the engaging portion is not provided in the width direction of the plug, the dimension in the width direction of the plug connector can be reduced.

In another embodiment of the present invention, the plurality of grooves for fitting terminals formed in the axial direction of the housing are covered by a portion of the housing cover, and therefore, the resin used to overmold the housing/housing cover is prevented from flowing to the front end of the plug connector by way of the grooves. In this case, it is further effective to provide a plurality of closing means to prevent this type of resin flow. Thus, contact failure between the plug connector and its mating connector can be prevented.

In another embodiment of the present invention, the clamp portion is made eccentric from the axis core of the shield case. Since the clamp portion is not provided in the axial direction of the shield case, the clamp portion does not prevent and/or hinder the housing from being easily inserted into the shield case. As such, the integration of the housing with the shield case is simplified.

DESCRIPTION OF THE DRAWINGS

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
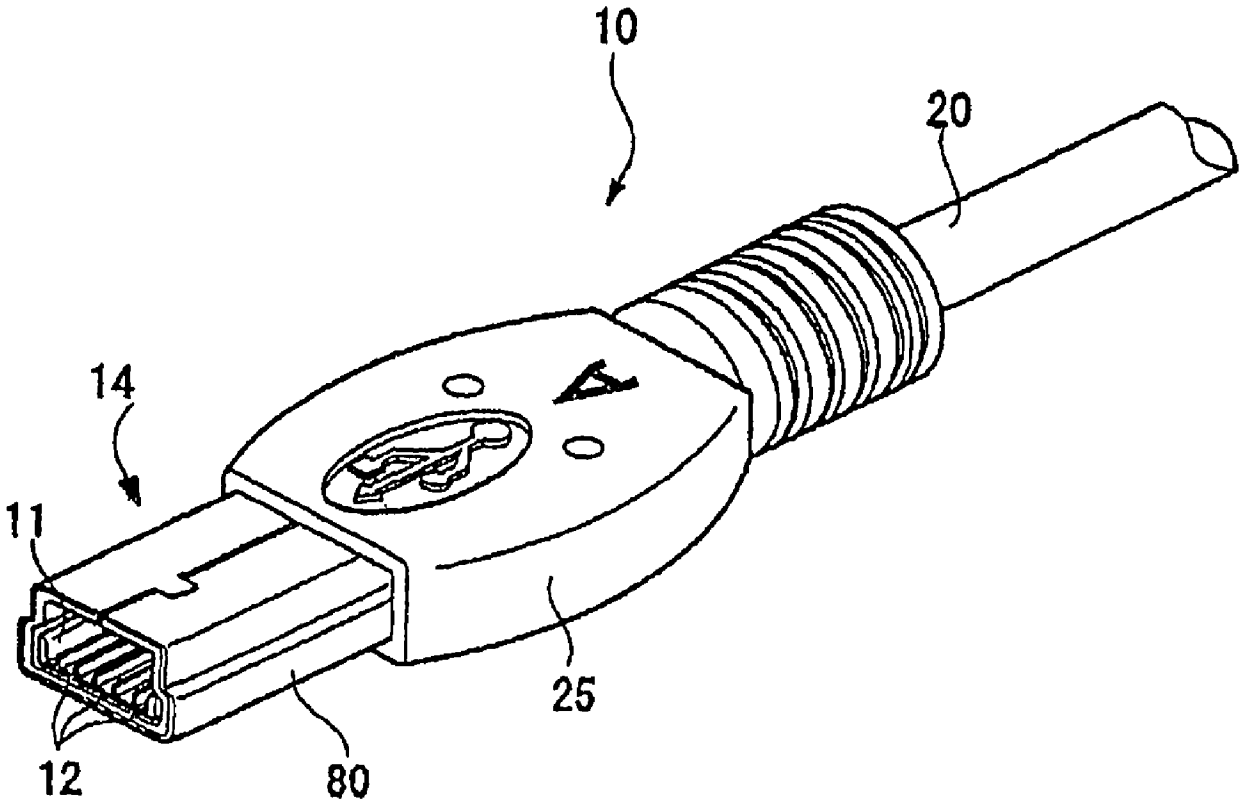
FIG. 1 is a perspective view of a USB cable adopting a plug according to the invention.

While the invention may be susceptible to embodiment in different forms, there is shown in the drawings, and herein will be described in detail, certain embodiments with the understanding that the present disclosure is to be considered an exemplification of the principles of the invention, and is not intended to limit the invention to that as illustrated and described herein.

In the embodiment shown in FIG. 1, a plug connector 10 has the same appearance as that in prior art described above. That is, a plug main body 24 is overmolded with resin to form a handhold portion 25, and a plug-in portion 80 constituting a portion of the plug main body 24 is projected from the handhold portion 25.

Figure 2:
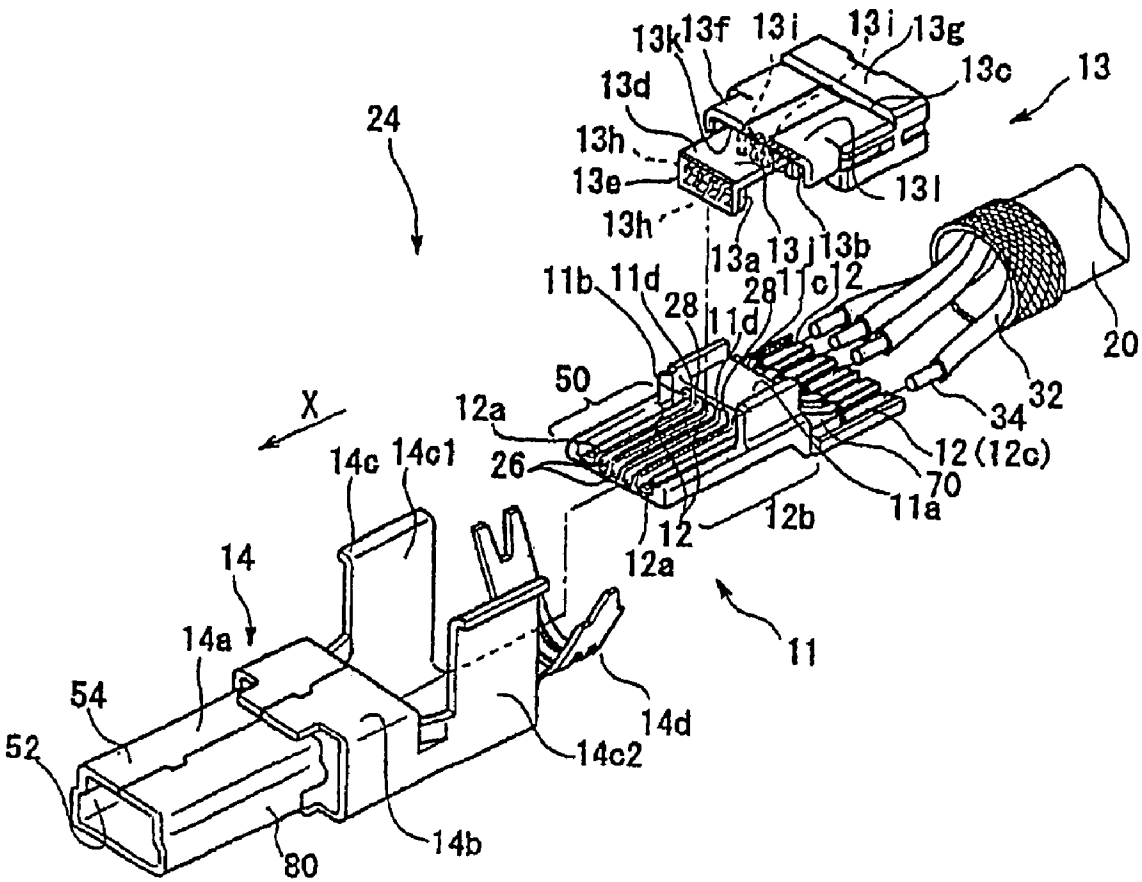
FIG. 2 is a perspective view of the plug connector according to one embodiment of the invention.
Figure 3:
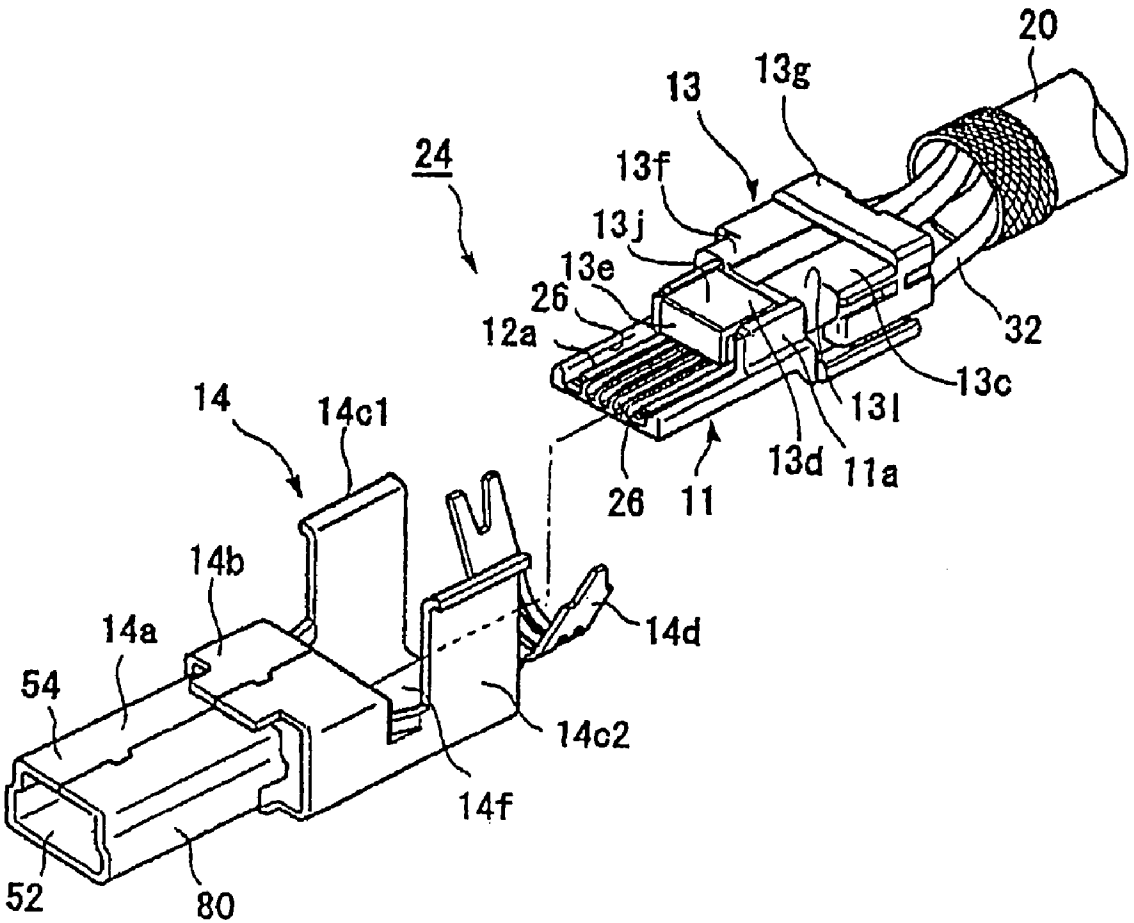
FIG. 3 is a perspective view of a housing mounted with a housing cover, and a shield case.

As shown in FIG. 2 and FIG. 3, the plug main body 24 is provided with a housing 11, terminals 12 fitted in the housing and connected to the cable 20 (5 terminals are shown in this embodiment), a housing cover 13 mounted to the housing 11 and covering at least a portion of the wires of the cable 20 and solder connection portions 12*c* of the terminals 12, and a shield case 14 for shielding the housing 11 and the housing cover 13. The housing 11, the terminals 12, and the housing cover 13 are substantially shielded by the shield case 14.

Figure 4:
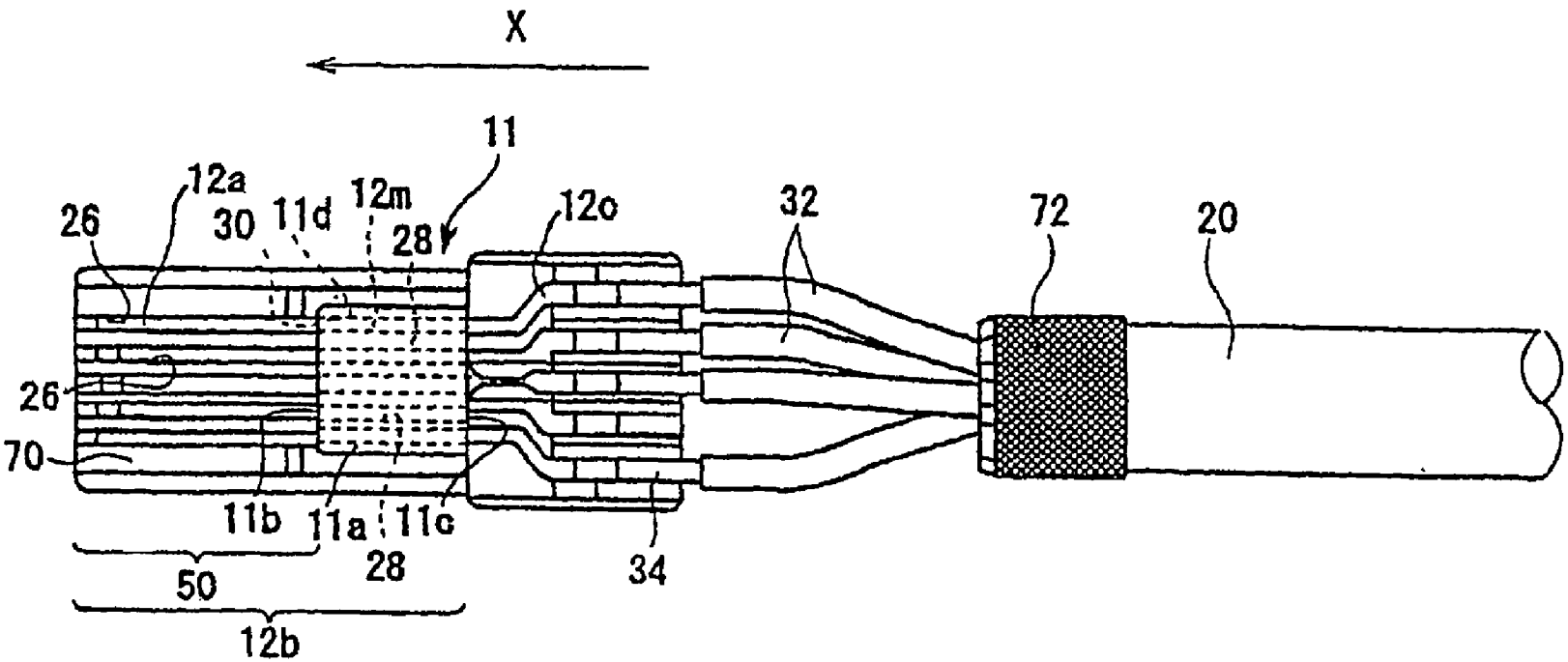
FIG. 4 is a plane view of a housing having a plurality of terminals soldered with a cable.

As shown in FIG. 2, the housing 11 is a flat plate-like member molded of an insulating resin. Further, an upper surface 70 of the housing 11 is formed with a plurality of grooves 26 extended in an axial direction, i.e., a direction designated by arrow X in FIG. 2. Terminals 12 are respectively fitted in the grooves 26. As shown in FIG. 2 and FIG. 4, at substantially the center of the housing 11, there is formed a three-dimensional intersecting portion 11*a* orthogonal to the grooves 26. The intersecting portion 11*a* is a projecting portion projected upwardly from the housing surface 70, and in the embodiment illustrated, is generally rectangular.

The rectangular bridge member 11*a* is provided with a through hole 11*d* opened to both ends thereof in the axial direction. The through hole 11*d* includes a plurality of partition walls 28 for equally partitioning the through hole 11*d* to correspond to the number of the grooves 26.

Small gaps 30 are formed at the through hole 11*d* by the partition walls 28. That is, the through hole 11*d* may be regarded as an aggregation of the small gaps 30. The bridge member includes 11*a* includes a fist face 11*b* on a front side in the axial direction of the rectangular bridge member 11*a* and a second face 11*c* on a rear side in the axial direction thereof.

The rectangular bridge member 11*a* and a portion 50 frontward therefrom are main portions of the housing 11 contained in the shield case 14, and is referred to as a main containing portion 12*b*. Further, the front portion 50 is a portion of the housing 11 at which front end portions of the terminals 12 are disposed.

The terminals 12 each comprise a conductive metal plate. Further, the terminals 12 are extended in the axial direction in the housing 11 and a front end portion 12*a* thereof contacts with a mating connector.

Further, as seen from FIG. 4, the rear end portions 12*c* of the terminals 12 are the solder connection portions connected to core wires 34 of electric wires 32 of the cable 20 by soldering. The terminals 12 are inserted into the small gaps 30 of the rectangular bridge member 11*a* by way of the grooves 26 of the housing 11. Further, as shown in FIG. 4, the respective terminals 12 are fixed to the housing surface 70 such that the intermediary portions 12*m* thereof are disposed in the small gaps 30.

Figure 9:
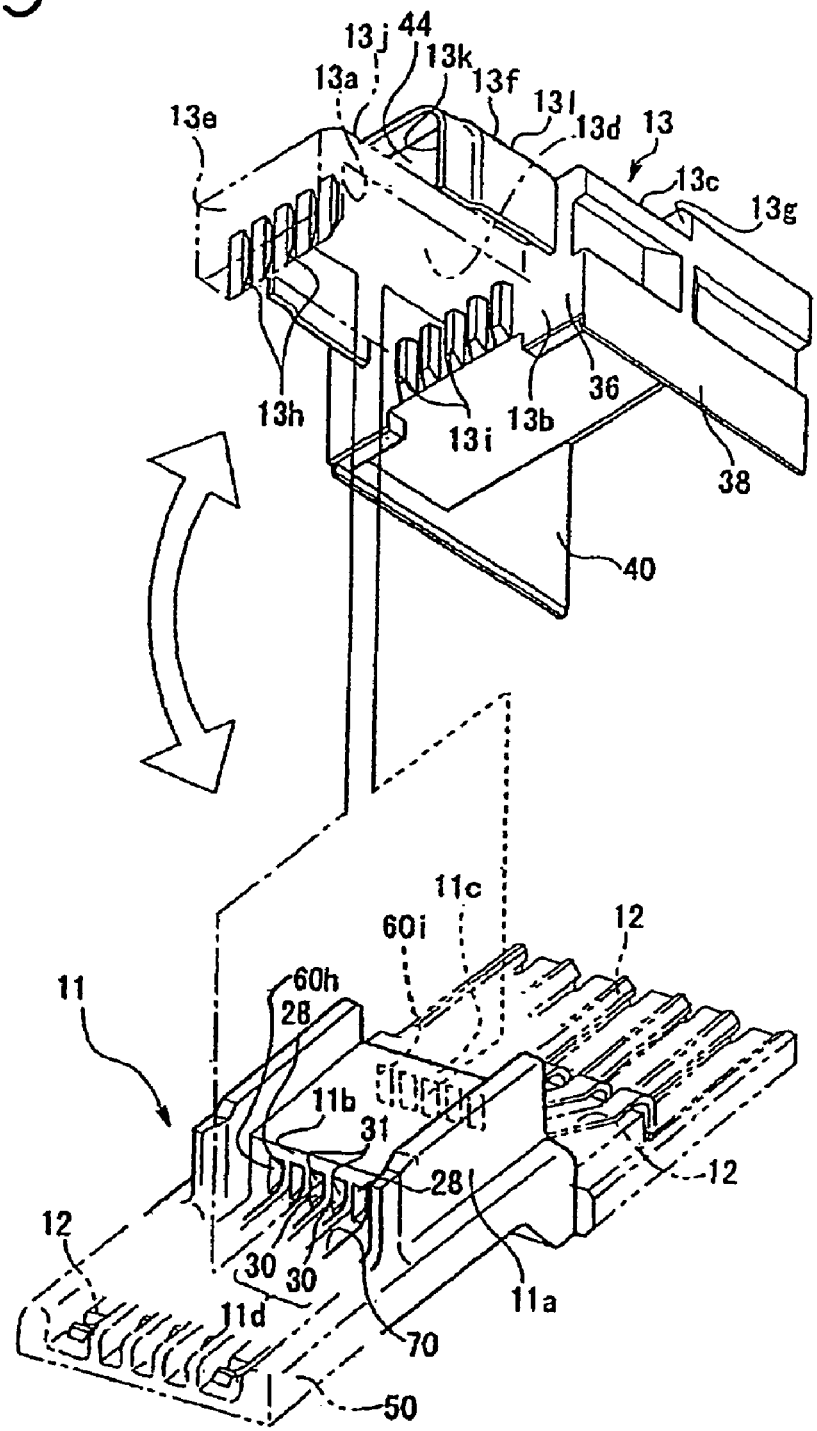
FIG. 9 is a partially omitted perspective view for illustrating the engaging relationship between a housing cover and a housing.
Figure 10:
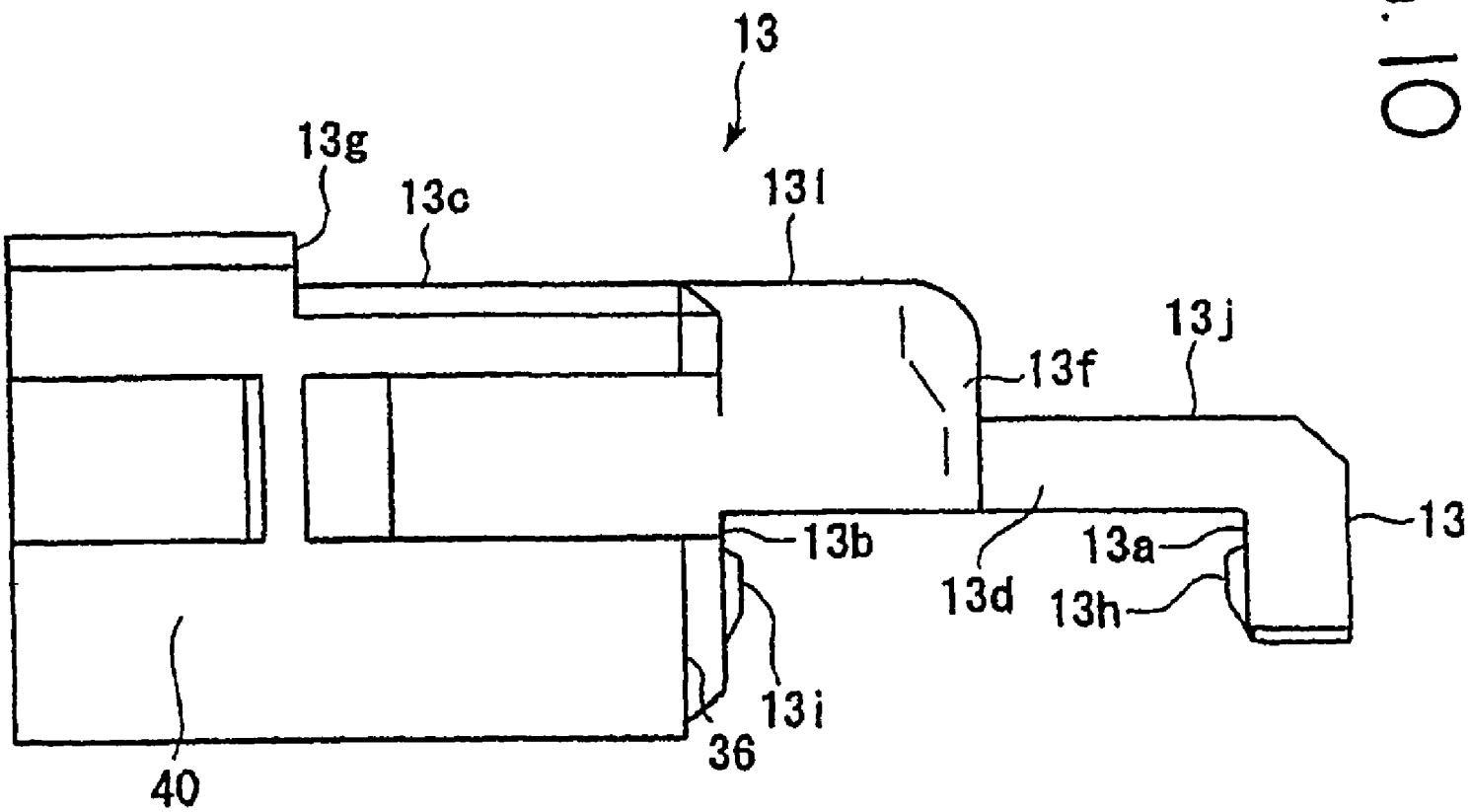
FIG. 10 is a side view of a housing cover.
Figure 11:
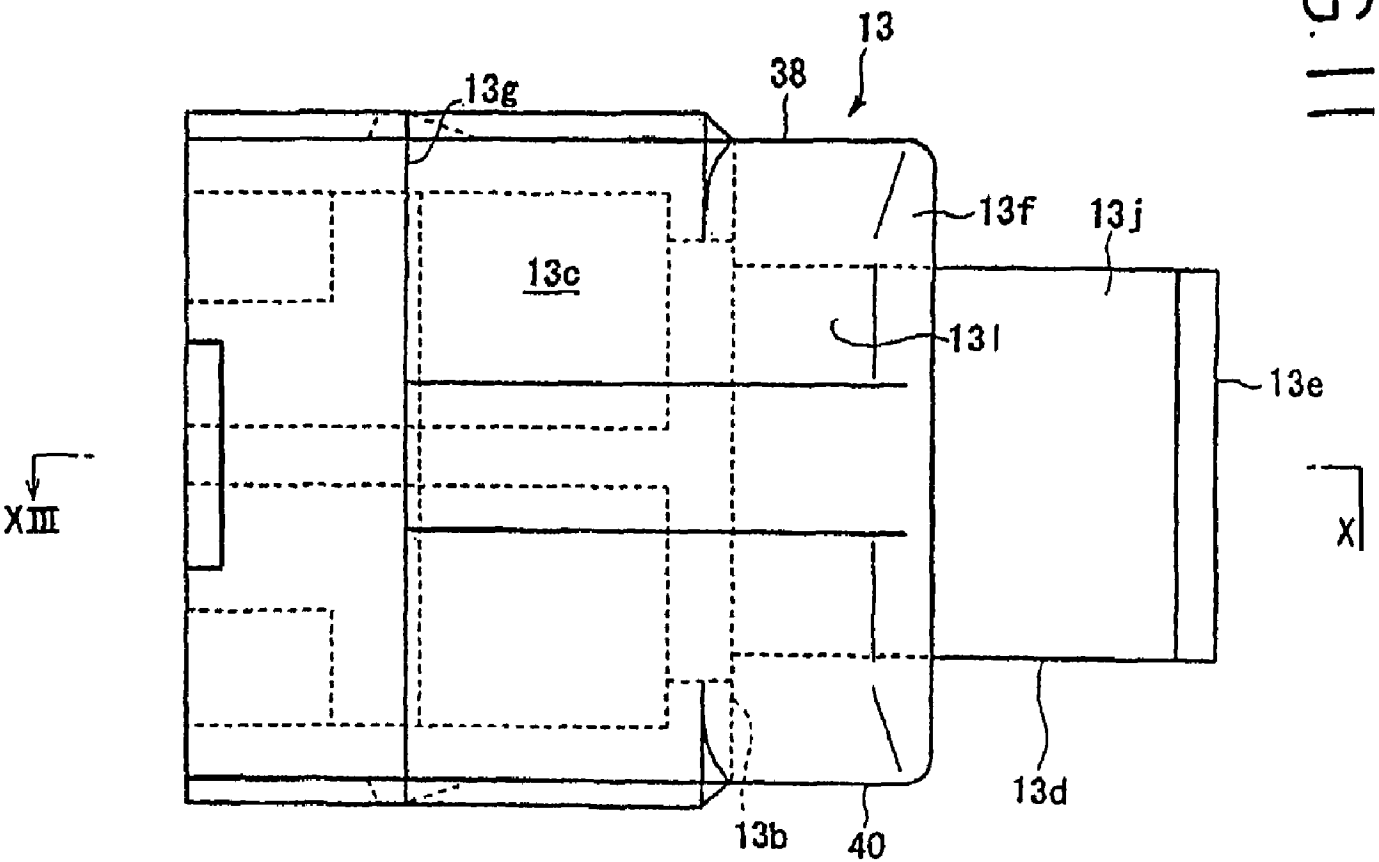
FIG. 11 is a plane view of a housing cover.
Figure 12:
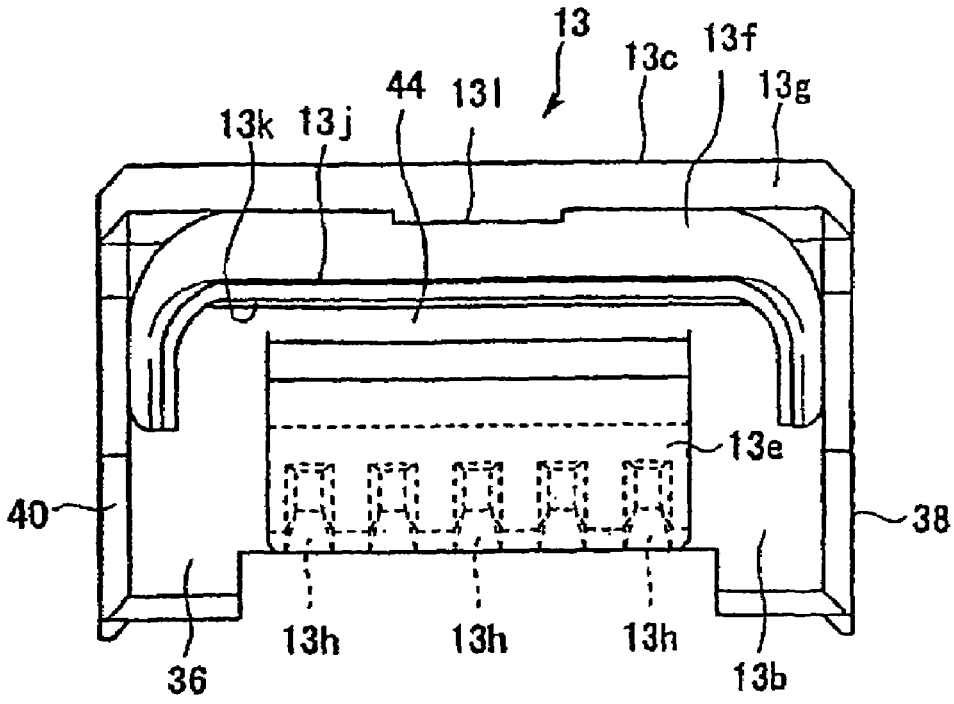
FIG. 12 is a front view of a housing cover.
Figure 13:
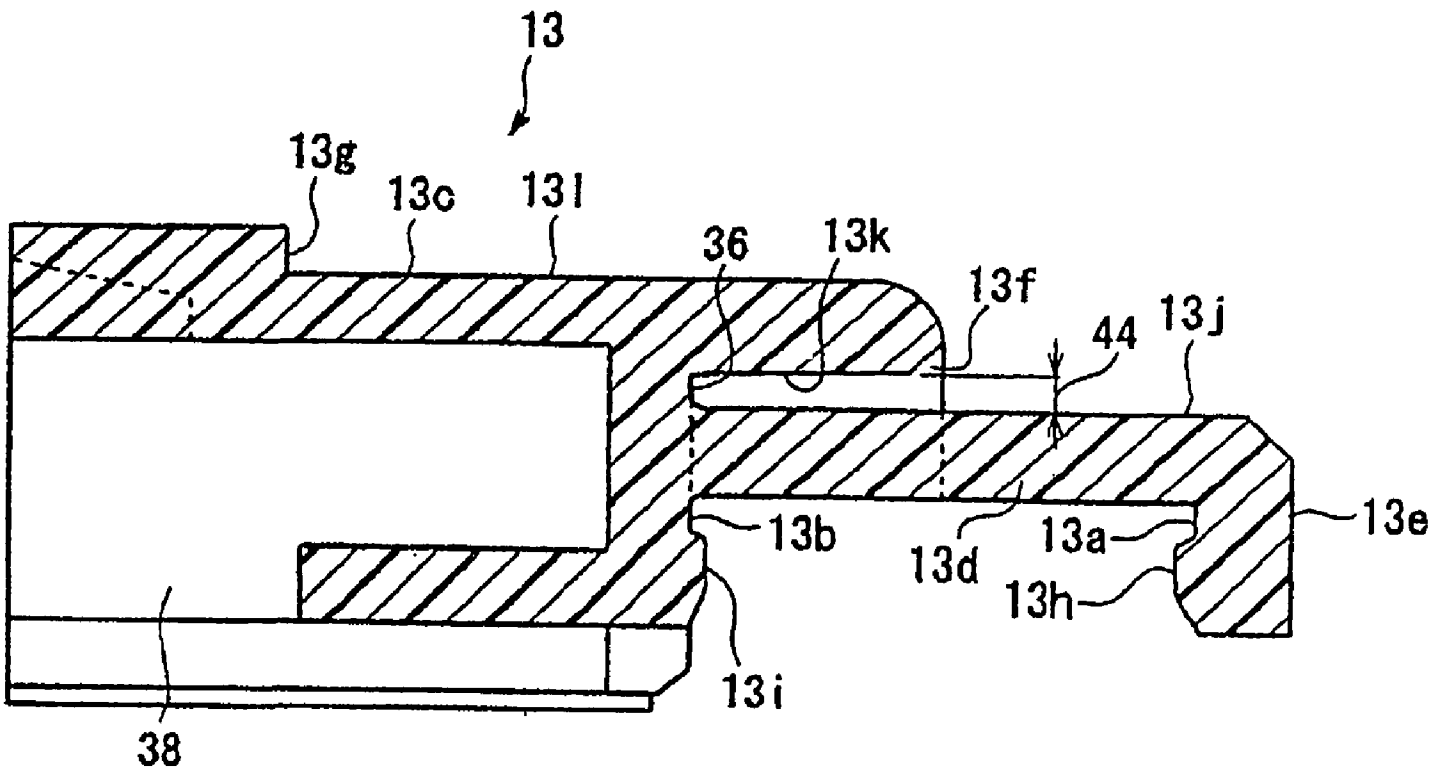
FIG. 13 is a cross sectional view taken along a line XII—XIII of FIG. 11.

As shown in FIG. 2 and FIG. 9, the housing cover 13 is a box-like member opened downwardly and rearwardly and substantially rectangular in plane view and is mountable to the housing 11. The housing cover 13 is provided with a main body 13*c* including a ceiling wall when the housing cover 13 is attached to the housing 11, a thick-walled front wall 36 extended downwardly from a front edge in peripheral edges of the housing cover main body 13*c*, and side walls 38, 40 extended downwardly therefrom, an eaves-like plate 13*f* in an inverted recess shape in its cross sectional face having a width slightly narrower than the housing cover main body 13*c* and extended forwardly from the front wall 36, a rectangular plate 13*d* projected from the front wall 36 disposed downward from the eaves-like plate 13*f* and in parallel therewith by being spaced apart from the eaves-like plate 13*f* by a small gap 44 and projected forward from the eaves-like plate 13*f*, and a downwardly hung plate 13*e* extended downwardly from a front end edge of the rectangular plate 13*d*.

Figure 7:
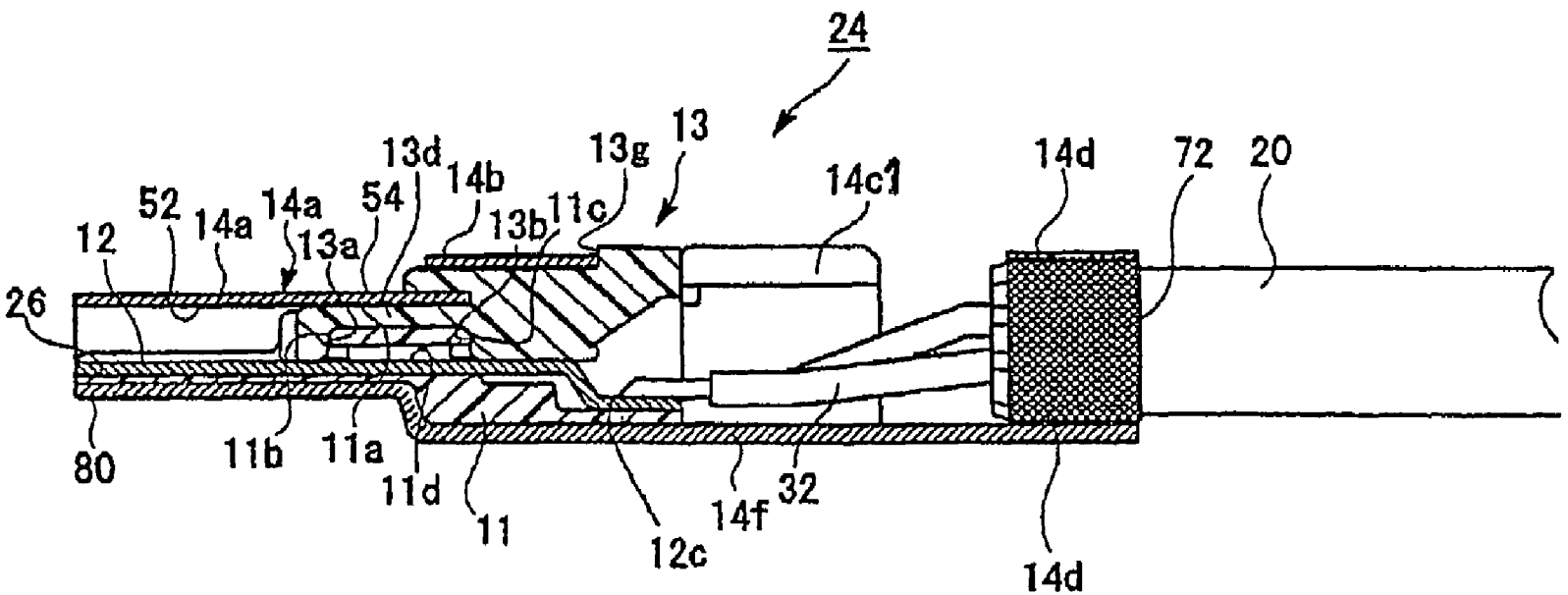
FIG. 7 is a cross sectional view of a plug main body before being overmolded by a resin.
Figure 8:
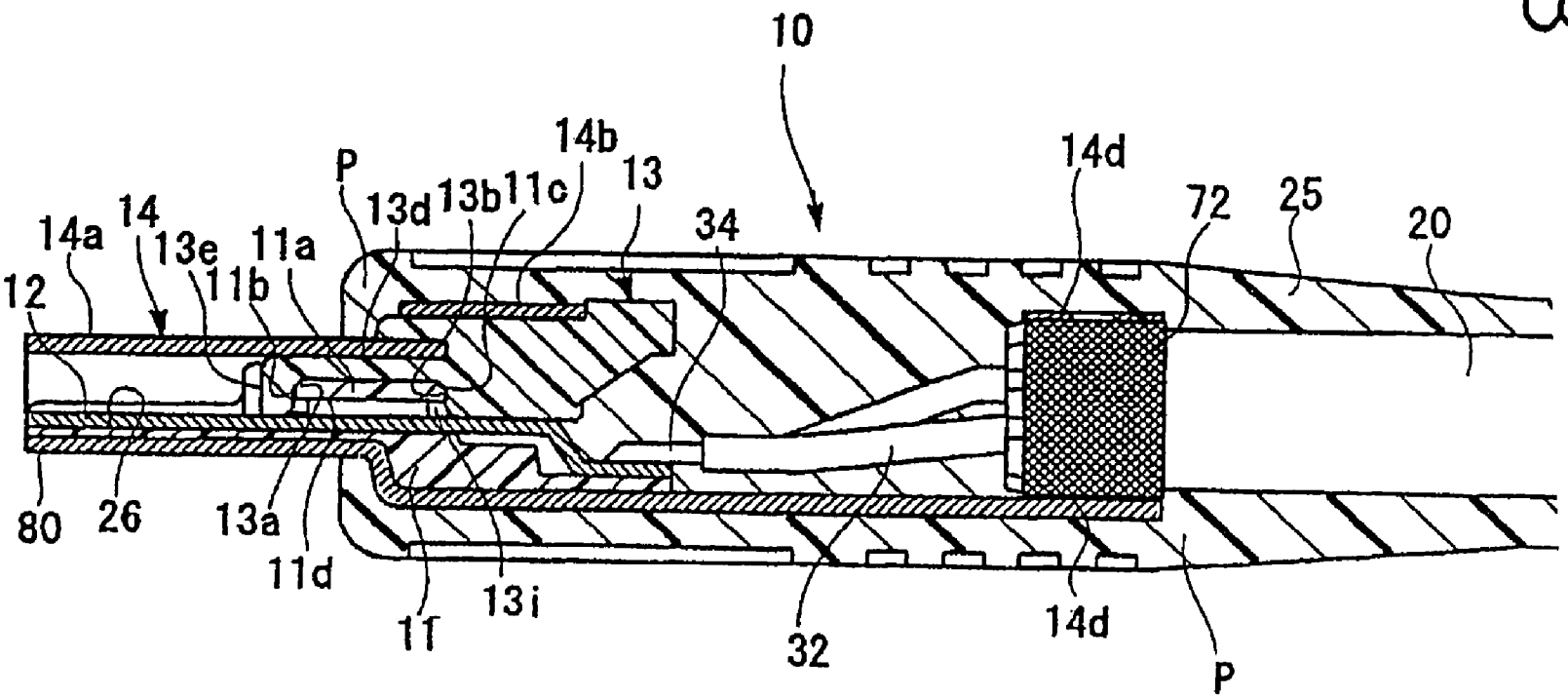
FIG. 8 is a cross sectional view of a plug.

A rear, or third, face 13*a* of the downwardly hung plate 13*e* is brought into contact with the first face 11*b* of the rectangular bridge member 11*a* when the housing cover 13 is mounted to the housing 11. A front, or fourth, face 13*b* of the front wall 36 is brought into contact with the second face 11*c* of the rectangular bridge member 11*a* when the housing cover 13 is mounted to the housing 11, as shown in FIGS. 7 and 8.

Further, as shown in FIG. 2, FIG. 3, FIG. 10, FIG. 15, an upper face 13*j* of the rectangular plate 13*d* is referred to as a fifth face, and a lower face 13*k* and an upper face 13*l* of the eaves-like plate 13*f* are respectively referred to as a sixth face 13*k* and a seventh face 13*l*, respectively. In addition, a projecting edge portion 13*g* is projected upwardly from a rear side of an upper face of the housing cover main body 13*c*. The projecting edge portion 13*g* prevents the shield case 14 from moving in the axial direction when the housing cover 13 is shielded by the shield case 14.

Figure 14:
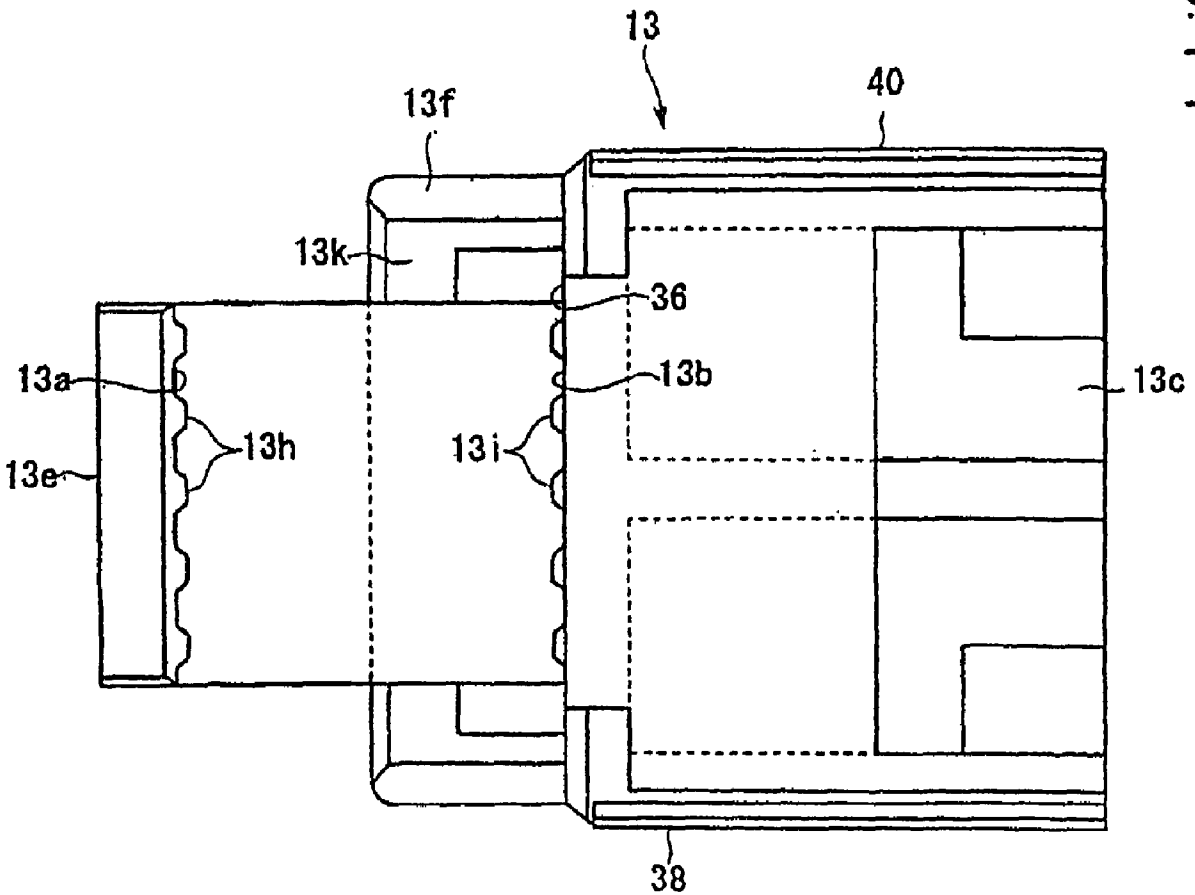
FIG. 14 is a bottom view of a housing cover.
Figure 15:
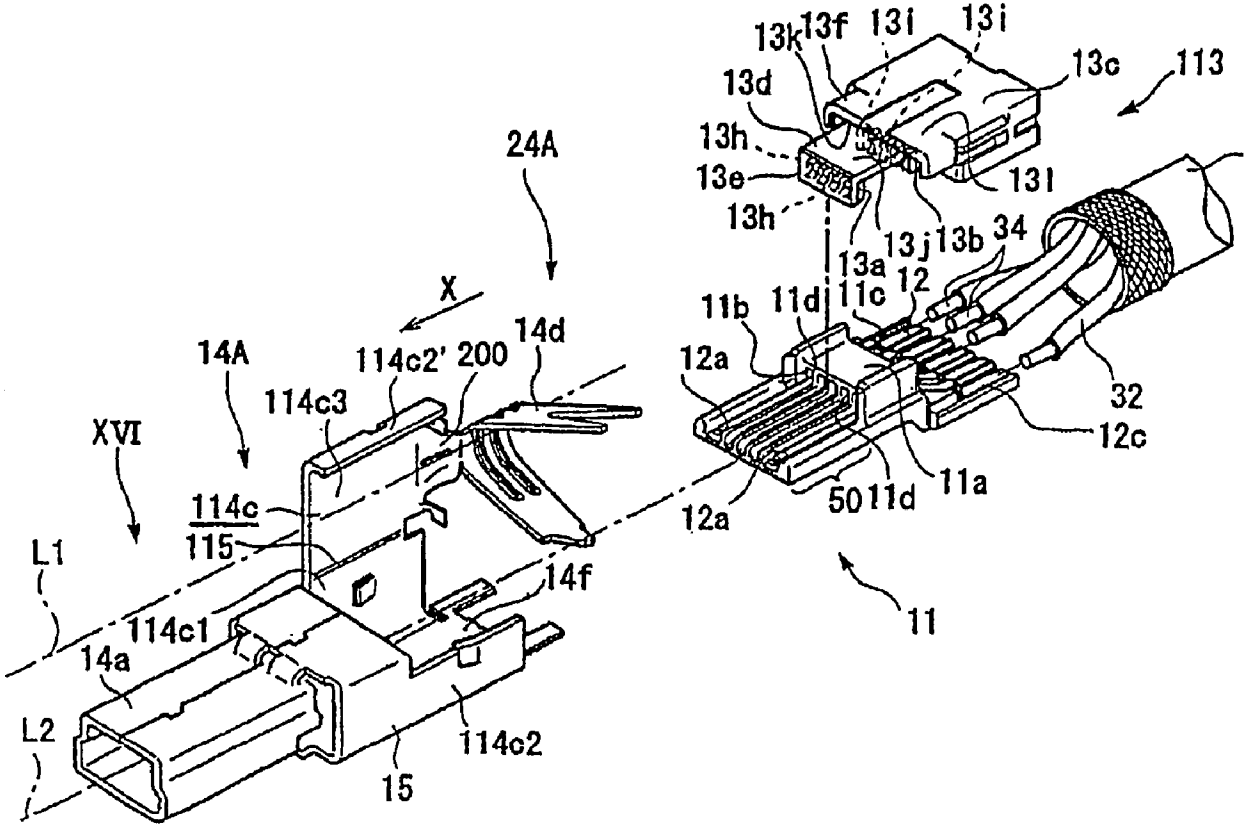
FIG. 15 is a perspective view of plug constituent parts according to an alternative embodiment of the invention.

As best shown in FIG. 14, the rear face 13*a* of the downwardly hung plate 13*e* of the housing cover 13 includes first projecting portions 13*h* engaged with the rectangular bridge member 11*a* of the housing 11. Each of the first projecting, or engaging, portions 13*h* is inserted into the small gaps 30 of the through hole 11*d* from the front, or first, side face 11*b* of the rectangular bridge member 11*a* when the housing cover 13 is mounted to the housing 11. Also at the front, or fourth, face 13*b* of the front wall 36 of the housing cover 13, there are provided second projecting, or engaging, portions 13*i* engaged with the rectangular bridge member 11*a* of the housing 11.

Similar to the first projecting portions 13*h*, in a state in which the housing cover 13 is mounted to the housing 11 (see FIG. 3), each of the second projecting portions 13*i* is also inserted into the small gaps 30 of the through hole 11*d* from a side of the second face 11*c* of the rectangular bridge member 11*a* of the housing 11. Therefore, the engaging projections 13*h* and 13*i* may be regarded as pairs of projections formed at positions respectively closing one opening 60*h* and the other opening 60*i* of the through hole 11*d* (see FIG. 9). Further, the pluralities of engaging projections 13*h* and 13*i* may be regarded as a plurality of small projections respectively fitted to openings of the small gaps 30 formed by the plurality of partition walls 28 (see FIG. 9). Therefore, the first projecting portions 13*h* and the small gaps 30 of the through hole 11*d* as well as the second projecting portions 13*i* and the small gaps 30 are also referred to as "engaging portions". By the fitting operation, the housing cover 13 is engaged with the housing 11 and cannot be detached therefrom.

According to the housing cover 13, the rear face (third face) 13*a* of the downwardly hung plate 13*e* and the face (fourth face) 13*b* on the front side of the front wall 36, are brought into contact with the first face 11*b* and the second face 11*c* of the rectangular bridge member 11*a*. At the same time, the first projecting portions 13*h* and the second projecting portions 13*i* respectively provided to these faces respectively close completely the two openings 60*h* and 60*i* of the through hole 11*d* as shown in FIG. 8 and FIG. 9.

Since the housing cover 13 is mounted to engage with the housing 11 in the axial direction, i.e., the length direction of the housing 11, and not in the width direction, the dimension of the plug 10 in the width direction can be reduced. Further, the engaging portions 13*h* and 13*i* and the small gaps 30 are provided in the housing 11 in the axial direction of the housing 11, thereby likewise contributing to the reduced width of the connector 10.

The shield case 14 is a conductive metal plate, and as shown in FIG. 2, FIG. 4 through FIG. 7, the shield case is provided with a cylindrical portion 14*a* in which the main containing portion 12*b* of the housing 11 and the rectangular plate 13*d* of the housing cover 13 mounted to the housing 11 are inserted, a hold portion 14*b* having a section in a rectangular shape continuous to the cylindrical portion 14*a* and having a diameter larger than that of the cylindrical portion 14*a* for fixing the eaves-like plate 13*f* of the housing cover 13 to hold from four sides, a surrounding portion 14*c* disposed rearward from the hold portion 14*b* and surrounding the solder connection portions 12*c* of the respective terminals 12, and a clamp portion (cable fixing portion) 14*d* disposed further rearward from the surrounding portion 14*c* for clamping a copper foil portion 72 of the cable 20. Centers of these portions, i.e., the cylindrical portion 14*a*, the hold portion 14*b* and the surrounding portion 14*c* are on the same axis core in plane view.

Figure 5:
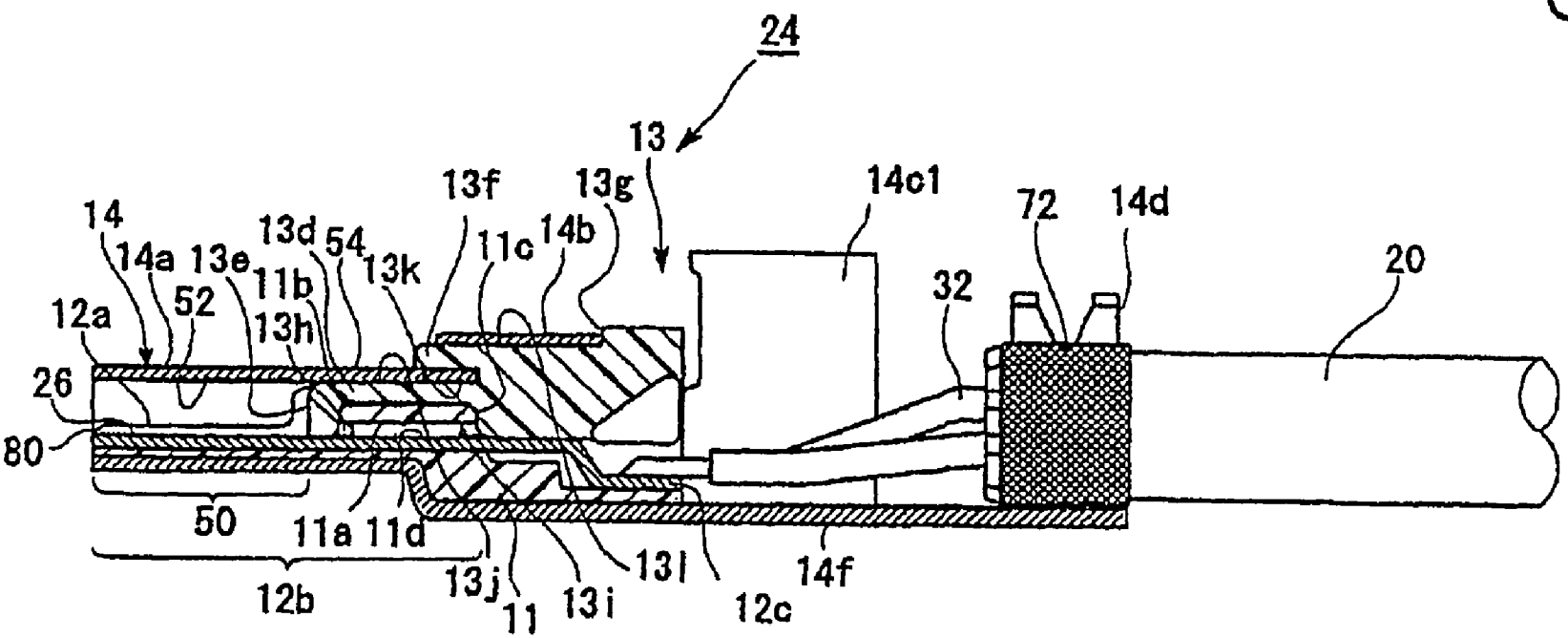
FIG. 5 is a cross sectional view of a housing in a state of being shielded by a shield case.

FIG. 5 is a sectional view showing the housing 11, to which the housing cover 13 is attached, inserted into the shield case 14. By inserting the main containing portion 12*b* of the housing 11 and the rectangular plate 13*d* of the housing cover 13 into the cylindrical portion 14*a* of the shield case 14, the main containing portion 12*b* and the housing cover 13 are held by the shield case 14. The fifth face 13*j* and the sixth face 13*k* of the housing cover 13 are brought into contact with an inner peripheral face 52 and an outer peripheral face 54 of the cylindrical portion 14*a* of the shield case 14 and the hold portion 14*b* of the shield case 14 is brought into contact with the seventh face 13*l*. A rear portion of the cylindrical portion 14*a* is sandwiched between the fifth face 13*j* and the sixth face 13*k* of the housing cover 13, and the eaves-like plate 13*f* is sandwiched between the hold portion 14*b* and the rear portion of the cylindrical portion 14*a* of the shield case 14.

Figure 6:
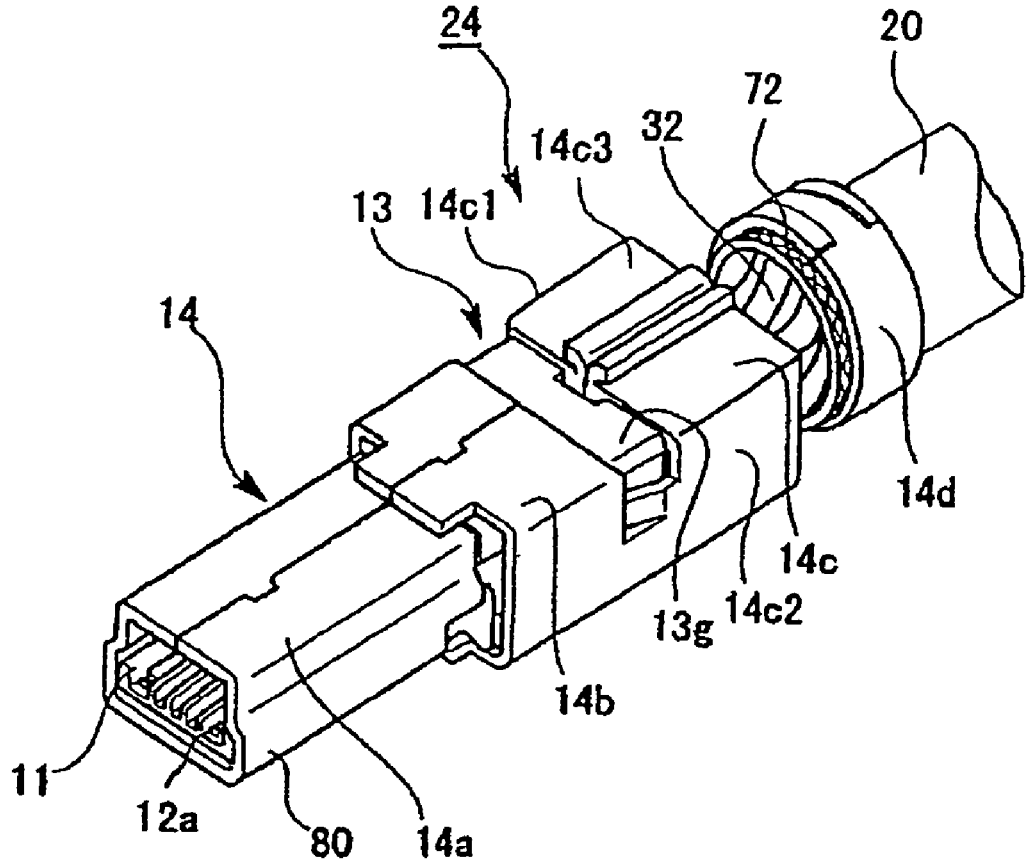
FIG. 6 is a perspective view of a plug main body before being overmolded by a resin.

As shown in FIG. 5 through FIG. 7, the electric wires 32 of the cable 20 are surrounded by the surrounding portion 14*c* of the shield case 14, and the cable 20 is fixed by the clamp portion 14*d* formed rearwardly in the axial direction from a bottom face wall 14*f* of the surrounding portion 14*c*. Further, the position of the clamp portion 14*d* is set to clamp the copper foil portion 72.

The surrounding portion 14*c* is formed in a U-like shape in which a cross sectional face thereof is opened upwardly and corner portions are provided with a right angle, before surrounding the electric wires 32 of the cable 20. The surrounding portion 14*c* is provided with a pair of wall members 14*c*1 and 14*c*2 having the same shape extended linearly and upwardly from the bottom portion of the shield case 14. Further, the surrounding portion 14*c* has a cross-sectional face that is the same rectangular shape as that of the hold portion 14*b* when the electric wires 32 of the cable 20 are surrounded and accordingly, the wall members 14*c*1 and 14*c*2 are bent at a right angle substantially at centers in the longitudinal direction and are closed. A ceiling wall 14*c*3 of the surrounding portion 14*c* is formed by bending the wall members 14*c*1 and 14*c*2.

As shown in FIG. 8, the plug main body 24 is overmolded by a resin P. However, the front end portion of the shield case 14, which is brought into contact with a mating connector, is not overmolded.

The housing 11 and the housing cover 13 are engaged in the axial direction and therefore, the dimension of the plug connector 10 in the width direction can be reduced. In other words, the first projection portions 13*h* and the small gaps 30 of the through hole 11*d* as well as the second projecting portions 13*i* and the small gaps 30, are not provided in the width direction of the plug and therefore, the dimension of the plug 10 in the width direction can be reduced. Further, the engaging portions are converged in the axial direction (length direction) of the housing 11 and therefore, the length of the plug 10 is not also increased.

Additionally, the first projecting portions 13*h* and the second projecting portions 13*i* (also referred to as engaging projections), close the front and rear openings in the axial direction of the through hole 11*d* of the rectangular bridge member 11*a* provided to cross the intermediary portions of the plurality of grooves 26 of the housing 11, that is, the front and rear opening of the small gaps 30, and therefore, when the plug main body 24 is overmolded with resin P, since the front and rear opening are closed respectively by the first projecting portions 13*h* and the second projecting portions 13*i*, even when the resin P flows to the grooves 26, the resin P can be prevented from flowing to the front of the plug by way of the plurality of grooves 26 by the first projecting portions 13*h* and the second projecting portions 13*i*. As a result, contact failure is not caused between the plug and the mating connector.

Further, the rear portion of the cylindrical portion 14*a* is sandwiched between the fifth face 13*j* constituting the upper face of the rectangular plate 13*d* of the housing cover 13 and the sixth face 13*k* constituting the lower face. The seventh face 13*l* constituting the upper face of the eaves-like plate 13*f* of the housing cover 13, is held by the hold portion 14*b* of the shield case 14 and therefore, even when wrenching force is exerted to the cylindrical portion 14*a* relative to the housing 11 or the housing cover 13, the hold portion 14*b* achieves cushioning operation. Therefore, durability of the plug 10 against the wrenching force can be promoted. Further, for achieving the cushioning operation, it is preferable to mold the housing cover 13 by an elastic material i.e., resin such as plastic or the like. The resin cover 13 having the cushioning operation contributes to improvement of impact resistance.

The plug 10 disclosed in the above-described embodiment may be also defined as follows.

(1) There is provided plug 10 having housing 11, terminals 12 mounted to the housing 11 and the housing cover 13 mounted to the housing 11, the housing 11 including first projecting portion 11*a* at its surface, the first projecting portion 11*a* is provided with the first face 11*b* orthogonal to the axial direction of the housing 11 and the second face 11*c* on the side opposite thereto, and is provided with the through hole 11*d* extended in the axial direction of the housing 11 between the first face 11*b* and the second face 11*c* and penetrated from the first face 11*b* to the second face 11*c*, the terminals 12 are arranged to the surface of the housing where the terminals 12 are extended in the axial direction of the housing 11, the contact portions 12*a* are provided at the one ends and the cable 20 is connected to the other ends, the terminals 12 are inserted into the through hole 11*d* and arranged at the surface of the housing in a state in which the intermediary portions 12*m* between the one ends and the other ends are disposed inside the through hole 11*d*, the housing cover 13 is provided with the third face 13*a* for closing the through hole 11*d* by being brought into contact with the first face 11*b* and the fourth face 13*b* for closing the through hole 11*d* by being brought into contact with the second face 11*c* in the state of being mounted to the housing 11, the third face 13*a* is provided with the first projecting portions 13*h* inserted into the through hole 11*d* from the side of the first face 11*b* in the state in which the housing cover 13 is mounted to the housing 11, and the fourth face 13*b* is provided with the second projecting portions 13*i* inserted into the through hole 11*d* from the side of the second face 11*c* when housing cover 13 is mounted to the housing 11.

(2) There is provided plug 10 having housing 11, terminals 12 mounted to the housing 11 and the housing cover 13 mounted to the housing 11, housing 11 including first projecting portion 11*a* at its surface, the first projecting portion 11*a* is provided with the first face 11*b* orthogonal to the axial direction of the housing 11 and the second face 11*c* on the side opposite thereto, and is provided with through hole 11*d* extended in the axial direction of the housing 11 between the first face 11*b* and the second face 11*c* and penetrated from the first face 11*b* to the second face 11*c*. The terminals 12 are arranged to the surface of the housing such that the terminals 12 are extended in the axial direction of the housing 11, the contact portions 12*a* are provided at the one ends and the cable 20 is connected to the other ends, the terminals 12 are inserted into the through hole 11*d* and arranged at the surface of the housing such that the intermediary portions 12*m* between the one ends and the other ends are inside the through hole 11*d*, the housing cover 13 is provided with the third face 13*a* for closing the through hole 11*d* by being brought into contact with the first face 11*b* and the fourth face 13*b* for closing the through hole 11*d* by being brought into contact with the second face 11*c*, the third face 13*a* is provided with the first projecting portions 13*h* inserted into the through hole 11*d* from the side of the first face 11*b* when the housing cover 13 is mounted to the housing 11, and the fourth face 13*b* is provided with the second projecting portions 13*i* inserted into the through hole 11*d* from the side of the second face 11*c* when the housing cover 13 is mounted to the housing 11, further provided with the housing shell 14 of conductive metal plate, having the cylindrical portion 14*a* inserted with the portion 50 of the housing 11 on the side at which the contact portions 12*a* of the terminals 12 are disposed and the housing cover 13, in which the cylindrical portion 14*a* holds the housing 11 and the housing cover 13 by surrounding the inserted portion 50 and the inserted housing cover 13.

(3) There is provided plug 10 having housing 11, terminals 12 mounted to the housing 11 and the housing cover 13 mounted to the housing 11, housing 11 including first projecting portion 11*a* at its surface, the first projecting portion 11*a* is provided with the first face 11*b* orthogonal to the axial direction of the housing 11 and the second face 11*c* on the side opposite thereto, and through hole 11*d* extended in the axial direction of the housing 11 between the first face 11*b* and the second face 11*c* and penetrated from the first face 11*b* to the second face 11*c*. Terminals 12 are arranged to the surface of the housing such that the terminals 12 are extended in the axial direction of the housing 11, the contact portions 12*a* are provided at the one ends and the cable 20 is connected to the other ends, the terminals 12 are inserted into the through hole 11*d* and arranged at the surface of the housing such that the intermediary portions 12*m* between the one ends and the other ends are disposed inside the through hole 11*d*. The housing cover 13 is provided with the third face 13*a* for closing the through hole 11*d* by being brought into contact with the first face 11*b* and the fourth face 13*b* for closing the through hole 11*d* by being brought into contact with the second face 11*c* when the cover 13 is mounted to the housing 11. The third face 13*a* is provided with the first projecting portions 13*h* inserted into the through hole 11*d* from the side of the first face 11*b* when the housing cover 13 is mounted to the housing 11, and the fourth face 13*b* is provided with the second projecting portions 13*i* inserted into the through hole 11*d* from the side of the second face 11*c* when the housing cover 13 is mounted to the housing 11, further provided with the housing shell 14 of conductive metal plate, having the cylindrical portion 14*a* inserted with the portion 50 of the housing 11 on the side at which the contact portions 12*a* of the terminals 12 are disposed and the housing cover 13. The cylindrical portion 14*a* holds the housing 11 and the housing cover 13 by surrounding the inserted portion 50 and the inserted housing cover 13. The housing cover 13 is provided with the fifth face 13*j* brought into contact with the inner peripheral face 52 of the cylindrical portion 14*a* of the housing shell 14, the sixth face 13*k* arranged upward from the fifth face 13*j*, brought into contact with the outer peripheral face 54 of the cylindrical portion 14*a* for sandwiching the cylindrical portion 14*a* between the sixth face 13*k* and the fifth face 13*j*, and the rectangular plate 13*d* having the sixth face 13*k* and the seventh face 13*l* disposed on a side opposite to the sixth face 13*k* constituting the surface of the housing cover 13, and the housing shell 14 is provided with the hold portion 14*b* holding the seventh face 13*l* by being brought into contact therewith.

(4) There is provided plug 10 having housing 11, terminals 12 mounted to the housing 11 and the housing cover 13 mounted to the housing 1, housing 11 including first projecting portion 11*a* at its surface, the first projecting portion 11*a* is provided with the first face 11*b* orthogonal to the axial direction of the housing 11 and the second face 11*c* on the side opposite thereto, and is provided with the through hole 11*d* extended in the axial direction of the housing 11 between the first face 11*b* and the second face 11*c* and penetrated from the first face 11*b* to the second face 11*c*. Terminals 12 are arranged to the surface of the housing such that the terminals 12 are extended in the axial direction of the housing 11, the contact portions 12*a* are provided at the one ends and the cable 20 is connected to the other ends, the terminals 12 are inserted into the through hole 11*d* and arranged at the surface of the housing such that the intermediary portions 12*m* between the one ends and the other ends are disposed inside the through hole 11*d*. The housing cover 13 is provided with the third face 13*a* for closing the through hole 11*d* by being brought into contact with the first face 11*b* and the fourth face 13*b* for closing the through hole 11*d* by being brought into contact with the second face 11*c*. The third face 13*a* is provided with the first projecting portions 13*h* inserted into the through hole 11*d* from the side of the first face 11*b* when the housing cover 13 is mounted to the housing 11, and the fourth face 13*b* is provided with the second projecting portions 13*i* inserted into the through hole 11*d* from the side of the second face 11*c* when the housing cover 13 is mounted to the housing 11, further provided with the housing shell 14 of conductive metal plate, having the cylindrical portion 14*a* inserted with the portion 50 of the housing 11 on the side at which the contact portions 12*a* of the terminals 12 are disposed and the housing cover 13, in which the cylindrical portion 14*a* holds the housing 11 and the housing cover 13 by surrounding the inserted portion 50 and the inserted housing cover 13. The housing cover 13 is provided with the fifth face 13*j* brought into contact with the inner peripheral face 52 of the cylindrical portion 14*a* of the housing shell 14, the sixth face 13*k* arranged upward from the fifth face 13*j*, brought into contact with the outer peripheral face 54 of the cylindrical portion 14*a* for sandwiching the cylindrical portion 14*a* between the sixth face 13*k* and the fifth face 13*j*, and the rectangular plate 13*d* having the sixth face 13*k* and the seventh face 13*l* disposed on a side opposite to the sixth face 13*k* constituting the surface of the housing cover 13. Housing shell 14 is provided with hold portion 14*b* holding the seventh face 13*l* by being brought into contact therewith, wherein the housing shell 14 is provided with the surrounding portion 14*c* for surrounding the cable 20 and is provided with the fixing portion 14*d* fixed to the cable 20.

In the plug connector of the present invention, the third face 13*a* and the fourth face 13*b* are respectively brought into contact with the first face 11*b* and the second face 11*c* orthogonal to the axial direction of the housing 11 to thereby close the through hole 11*d*. That is, the housing cover 13 is mounted to the housing 11 by being brought into contact with the two side faces in the axial direction of the housing 11 and at that occasion, the housing cover 13 is not brought into contact with the two side faces in the width direction of the housing 11. Therefore, the dimension in the width direction of the housing 11 can be reduced, which results in the dimension in the width direction of the plug 10 similarly being reduced.

Further, when an interval between the third face 13*a* and the fourth face 13*b* of the housing cover 13 is less than an interval between the first face 11*b* and the second face 11*c* of the projecting portion 11*a*, the housing cover 13 is securely mounted to the projecting portion 11*a*.

The third face 13*a* is provided with the first projecting portions 13*h* inserted into the through hole 11*d* from the side of the first face 11*b* in the state in which the housing cover 13 is mounted to the housing 11 and the fourth face 13*b* is provided with the second projecting portions 13*i* inserted into the through hole 11*d* from the side of the second face 11*c* in the state in which the housing cover 13 is mounted to the housing 11. Therefore, the housing cover 13 is mounted firmly to the housing 11 by inserting (engaging) the respective projecting portions 13*h* and 13*i* into the through hole.

Further, the respective projecting portions 13*h* and 13*i* are inserted into the through hole 11*d* in the close contact state. Therefore, even when the resin assumedly flows into the through hole 11*d* in overmolding due to the fact that there is a gap between the second face 11*c* and the fourth face 13*b*, the resin is dammed from flowing by the first face 11*b* and the third face 13*a* on the downstream side in the flowing direction of the resin. Therefore, the resin can sufficiently be prevented from invading the contact portions 12*a* of the terminals at the front end of the plug via the through hole 11*d*.

The plug 10 is further provided with the housing shell 14 having the cylindrical portion 14*a* comprising the conductive metal plate and inserted with the portion 50 at which the contact portions 12*a* of the terminals 12 are disposed and the housing cover 13 and the cylindrical portion 14*a* holds the housing cover 13 relative to the housing 11 by surrounding the inserted portion 50 and the inserted housing cover 13. Therefore, mounting the housing cover 13 relative to the housing 11 can be maintained by one sheet of the conductive metal plate. There are not needed a plurality of parts such that the part is divided in two for maintaining the mounted state as in the conventional case. Therefore, there can be provided the plug at comparatively low cost.

The housing cover 13 is provided with the fifth face 13*j* brought into contact with the inner peripheral face of the cylindrical portion when it is inserted into the cylindrical portion 14*a* of the housing shell 14, the sixth face 13*k* arranged upward from the fifth face 13*j*, brought into contact with the outer peripheral face 54 of the cylindrical portion

14*a* and sandwiching the cylindrical portion 14*a* between the sixth face 13*k* and the fifth face 13*j*, and the plate 13*f* having the sixth face 13*k* and the seventh face 13*l* and the housing shell 14 is provided with the hold portion 14*b* for holding the seventh face 13*l* by being brought into contact therewith. Therefore, the cylindrical portion 14*a* is sandwiched between the fifth face 13*j* and the sixth face 13*k*. The seventh face 13*l* on the side opposite to the sixth face 13*k* is held by the hold portion 14*b* and when force for wrenching the housing 11 or the housing cover 13 is exerted to the cylindrical portion 14*a*, the hold portion achieves cushioning operation. Therefore, durability of the plug 10 against wrenching can be improved. In order to achieve the cushioning operation, it is preferable to mold the housing cover 13 by an elastic material i.e. resin such as plastic or the like. The housing cover 13 having such a cushioning operation contributes also to improvement of impact resistance of the plug 10.

The housing shell 14 includes the surrounding portion 14*c* for surrounding the cable 20. Therefore, the cable 20 can be shielded. The housing shell 14 also includes fixing portion 14*d* fixed to the cable 20. Therefore, the housing 11 inserted into the cylindrical portion 14*a* of the housing shell 14 and the cable 20 can be connected further firmly.

An alternative embodiment of connector plug 10A is shown in FIG. 15 through FIG. 26. A point of a difference of the plug 10A according to the alternative embodiment from the plug 10 according to the previously described (first) embodiment, resides in a mode of a shield case 14A and a point related thereto. Therefore, an explanation will be given only for the difference, the same portions are attached with the same notations as the notations used in the first embodiment and an explanation thereof will be omitted.

First, as shown in FIG. 15 through FIG. 24, a description will be given for a surrounding portion 114*c* corresponding to the surrounding portion 14*c* according to the first embodiment. A shape of a cross-sectional face of the surrounding portion 114*c* surrounding the electric wires 32 of the cable 20 at least after integrating a plug main body 24*a*, is substantially rectangular similar to the surrounding portion 14*c* according to the first embodiment.

Figure 16:
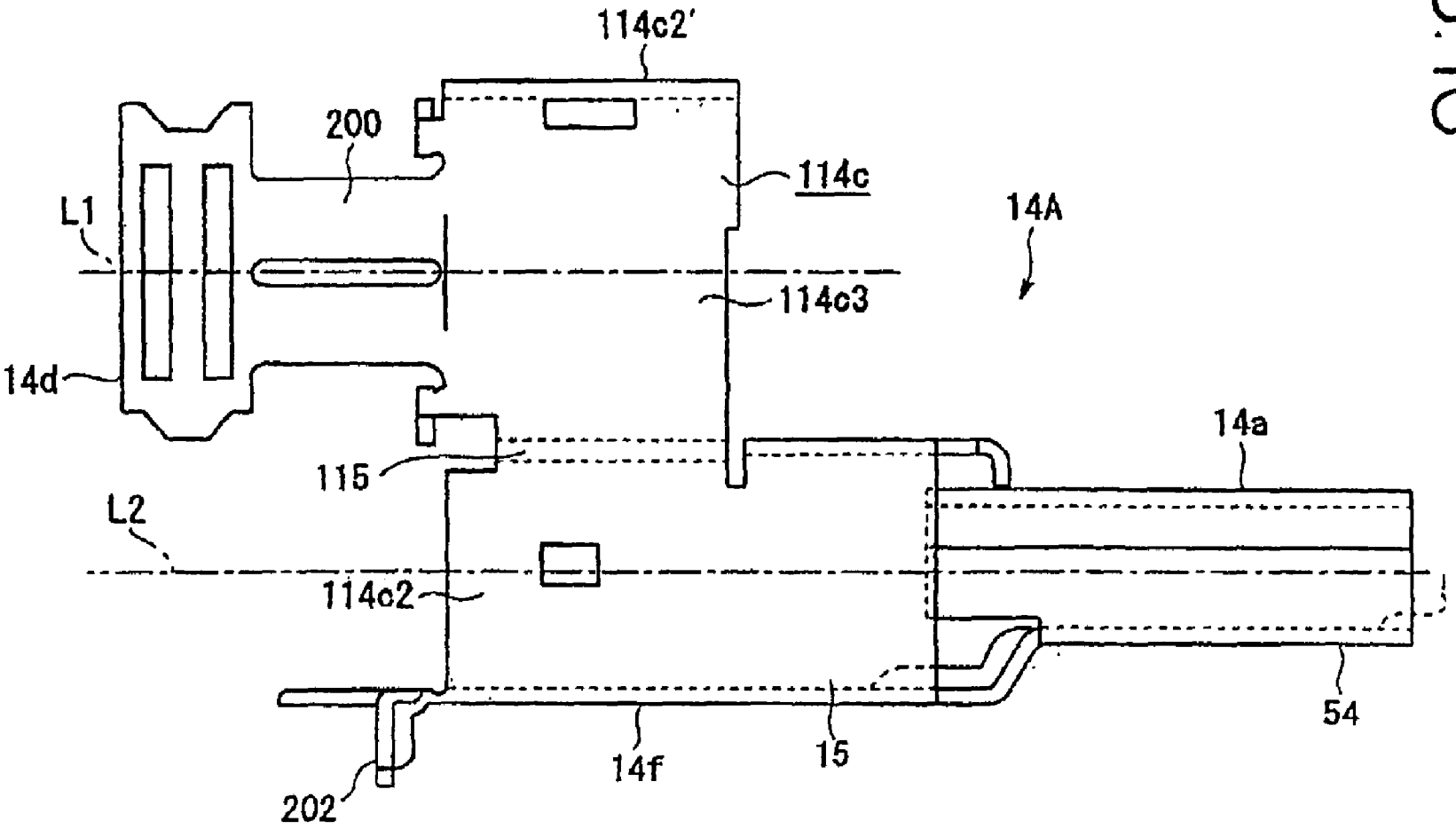
FIG. 16 is a side view of a shield case according to the alternative embodiment of the invention and is a view viewing from an arrow mark XVI direction of FIG. 15.
Figure 17:
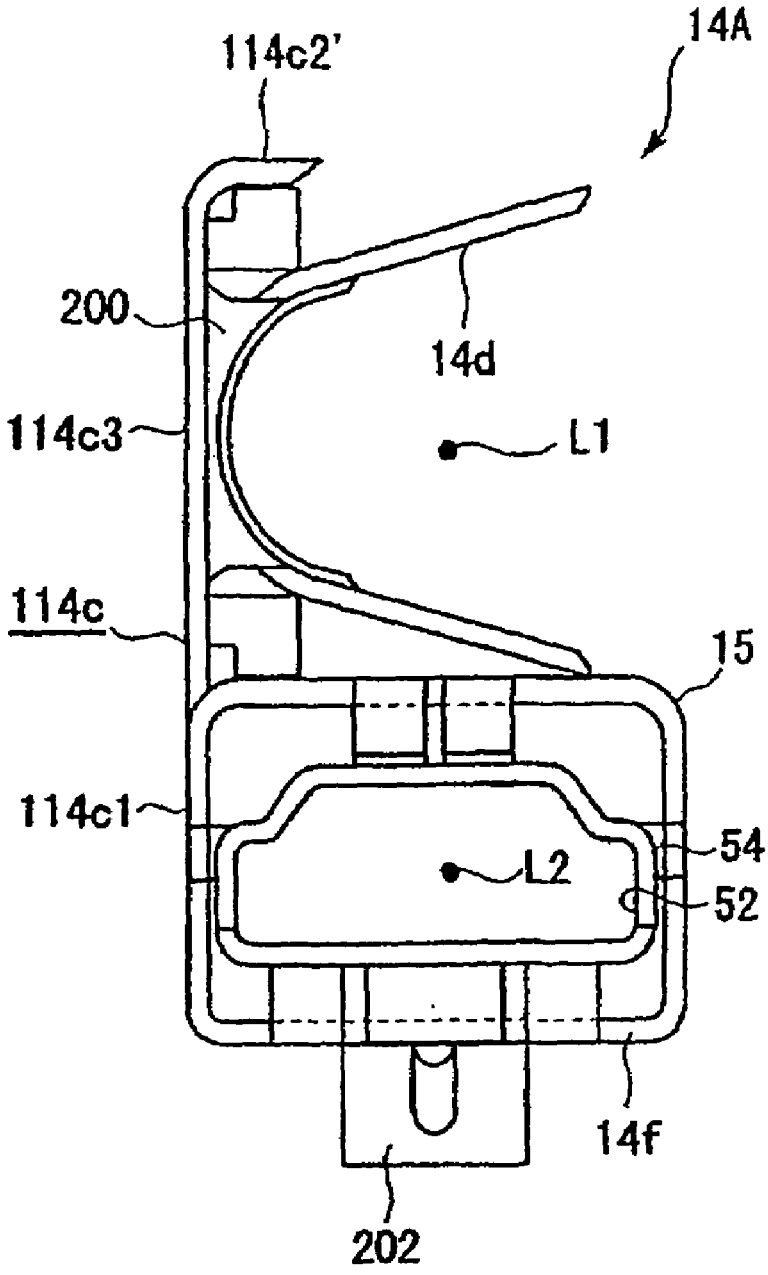
FIG. 17 is a front view of a housing shield.
Figure 20:
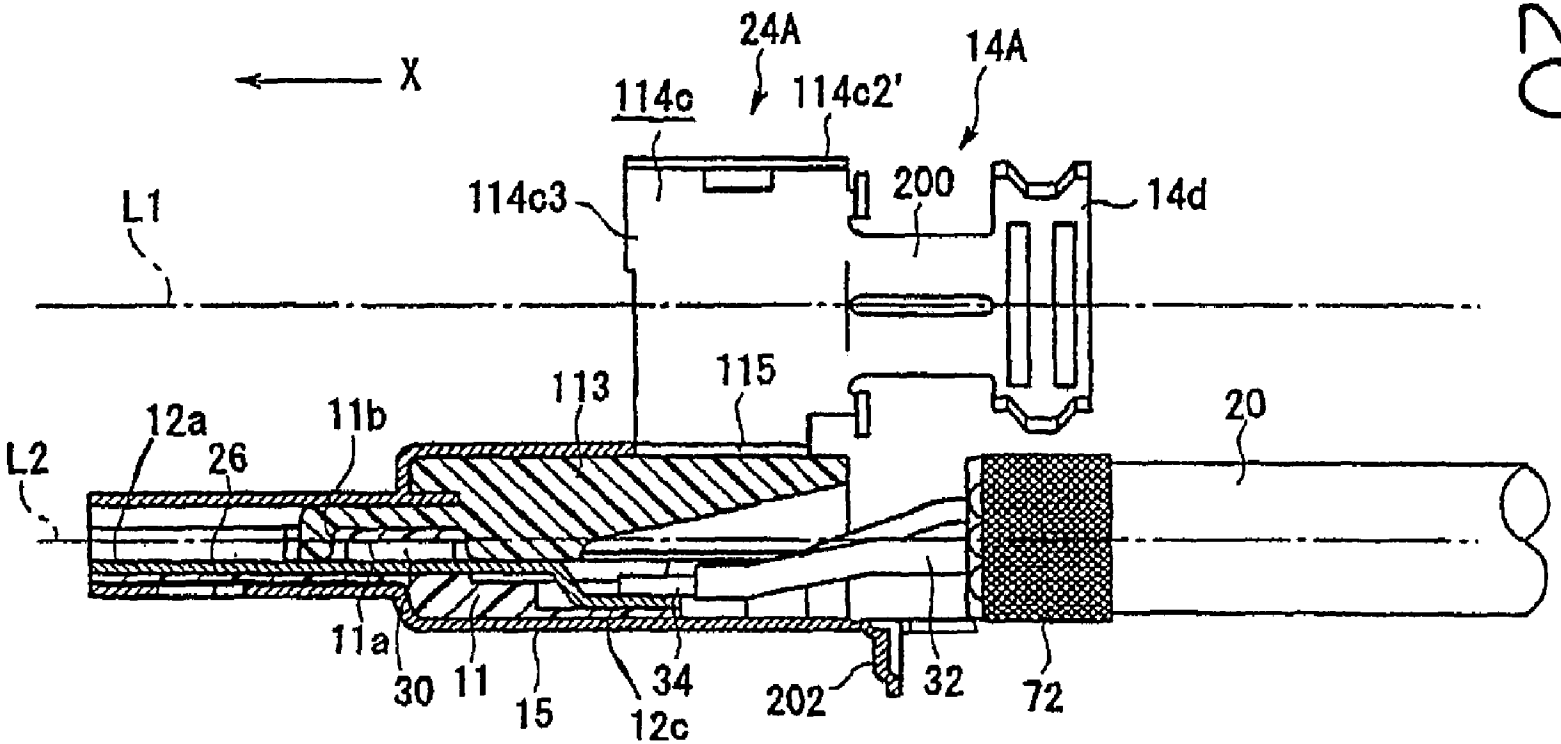
FIG. 20 is a cross sectional view showing a state in which the housing of FIG. 19 is inserted into a shield case.

Prior to surrounding the electric wires 32, wall members 114*c*1 and 114*c*2 respectively correspond to the wall members 14*e*1 and 14*c*2 of the surrounding portion 14*c*. Ceiling wall 114*c*3 corresponding to the ceiling wall 14*c*3 of the surrounding portion 14*c* according to the first embodiment, is integrally formed with the wall member 114*c*1 on an upper side thereof. Further, from a rear edge of the ceiling wall 114*c*3, there is integrally formed the clamp portion 14*d* extended rearwardly in the axial direction via a joint 200 and opened in a left side direction (see FIG. 15). Although the ceiling wall 114*c*3, the joint 200 and the clamp portion 14*d* are disposed on the same axial line L1 in side view, both members are eccentric from an axis core L2 of the shield case 14A as shown in FIG. 16, FIG. 17 and FIG. 20.

Further, from a left side edge of the ceiling wall 114*c*3, wall member 114*c*2 having a height corresponding to substantially half of wall member 14*c*2, is formed integrally with the ceiling wall 114*c*3. Ceiling wall 114*c*3 is inscribed with a folding line 115 at a portion of the ceiling wall 114*c*3 constituting a boundary with the wall member 114*c*1 such that the ceiling wall 114*c*3 can be bent to fold The wall member 114*c*2 is provided with a height dimension substantially a half of the wall member 14*c*2 according to the first embodiment as shown in FIG. 17.

Figure 24:
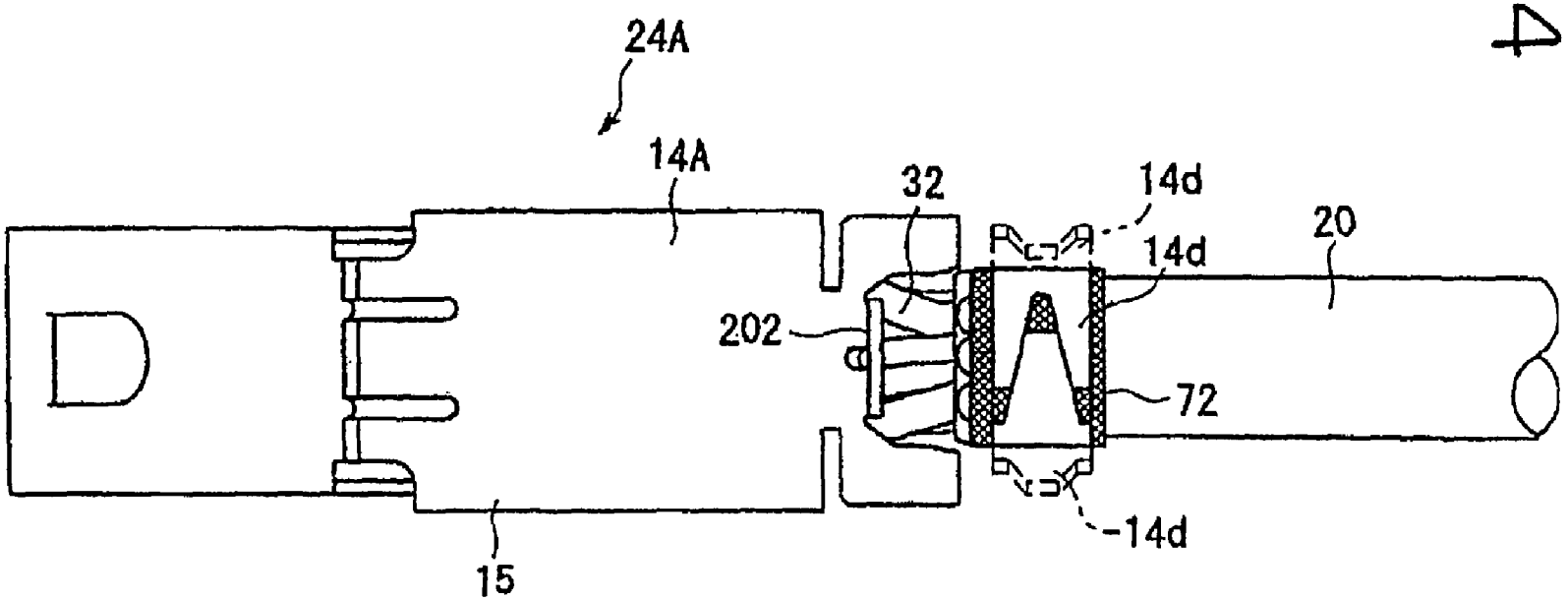
FIG. 24 is a bottom view of FIG. 22 and is a view showing a state of clamping a copper foil portion.

The position of the clamp portion 14*d* via the joint 200 is set such that the copper foil portion 72 can be clamped in integrating the plug 10 as shown in FIG. 24. Further, there is provided a hold plate 202 for holding the electric wires 32 from a rear end edge of the bottom wall 14*f* of the surrounding portion 114*c* rearwardly in the axial direction in integrating the plug main body 24A.

In addition thereto, the housing cover 113 corresponding to the housing cover 13 according to the first embodiment, is not provided with a projecting edge portion 13*g* which is present in the housing cover 13. Therefore, the housing cover main body 13*c* forms a flat face. The ceiling wall 114*c*3 functions as a cover shield portion for shielding a rear half portion of the housing cover 113.

Joint 200 also covers the upper sides of the electric wires 32 disposed between the housing cover 113 and the copper foil portion 72.

Further, according to the alternative embodiment, the shield case 14A and the clamp portion 14*d* are eccentrically provided Therefore, in the specification, for convenience, a portion of the shield case 14A other than the clamp portion 14*d*, is referred to as a shield case main body 15.

In the plug 10A according to the alternative embodiment, there are adopted the shield case main body 15 for shielding the housing 11 having the plurality of terminals 12 connected to the cable 20 and the housing cover 113 attached to the housing 11 and covering the cable 20 and the solder connection portions 12*c* of the terminals 12, and the shield case 14A that is provided eccentrically from the axis core L2 of the shield case main body 15 to L1 and has the clamp portion 14*d* for clamping the portion of the cable 20 turned back by peeling off the cover 21 of the cable 20 for soldering the core wires 34 of the cable 20 to the terminals 12.

Further, the clamp portion 14*d* is on the same axis core as that of the ceiling wall 114*c*3, which is the cover shield portion for shielding the housing cover 113 covering the solder connection portions 12*c* of the terminals 12.

One method of integrating the plug 10A into the shield case 14A is shown in FIG. 18 through FIG. 26.

Figure 18:
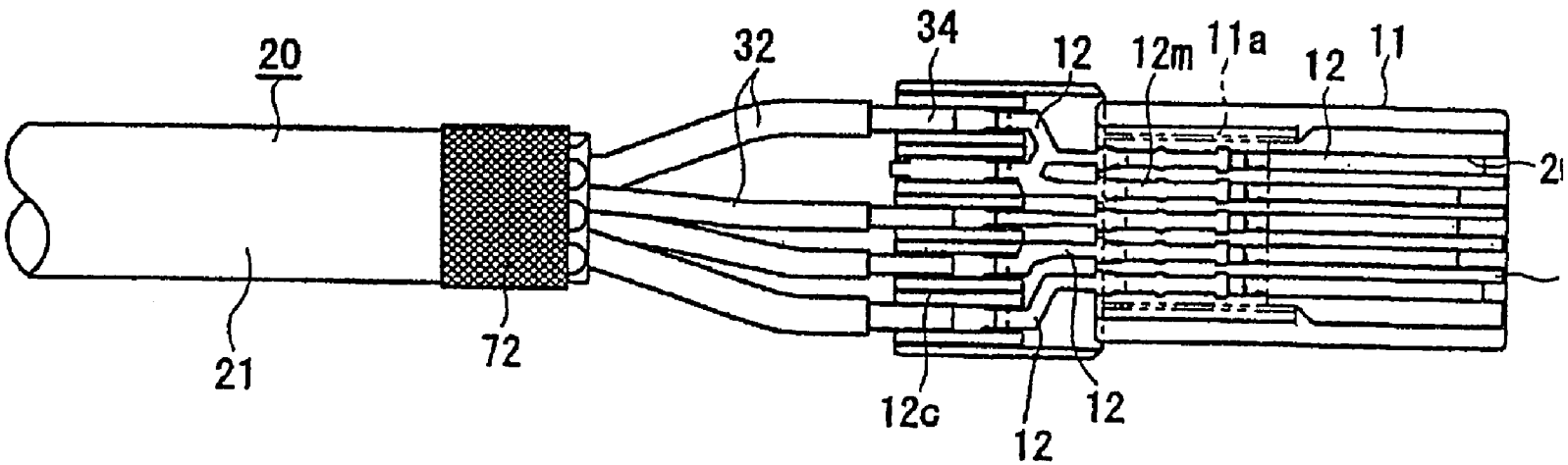
FIG. 18 is a shell showing a state in which an exposed core wire is soldered to a terminal of a housing removed of a housing cover.

First, as shown in FIG. 18, the cable 20 exposed with the core wires 34, is soldered to the terminals 12 of the housing 11. Before the wires 34 are soldered to the terminals 12, a portion of the cover 21 of the cable 20 is peeled off, the knitted shield and the drain wire in the cable 20 are turned back to an outer periphery of the cover 21 and a copper foil tape, not illustrated, is wrapped around the turned-back knitted shield and drain wire to thereby constitute the copper foil portion 72.

Figure 19:
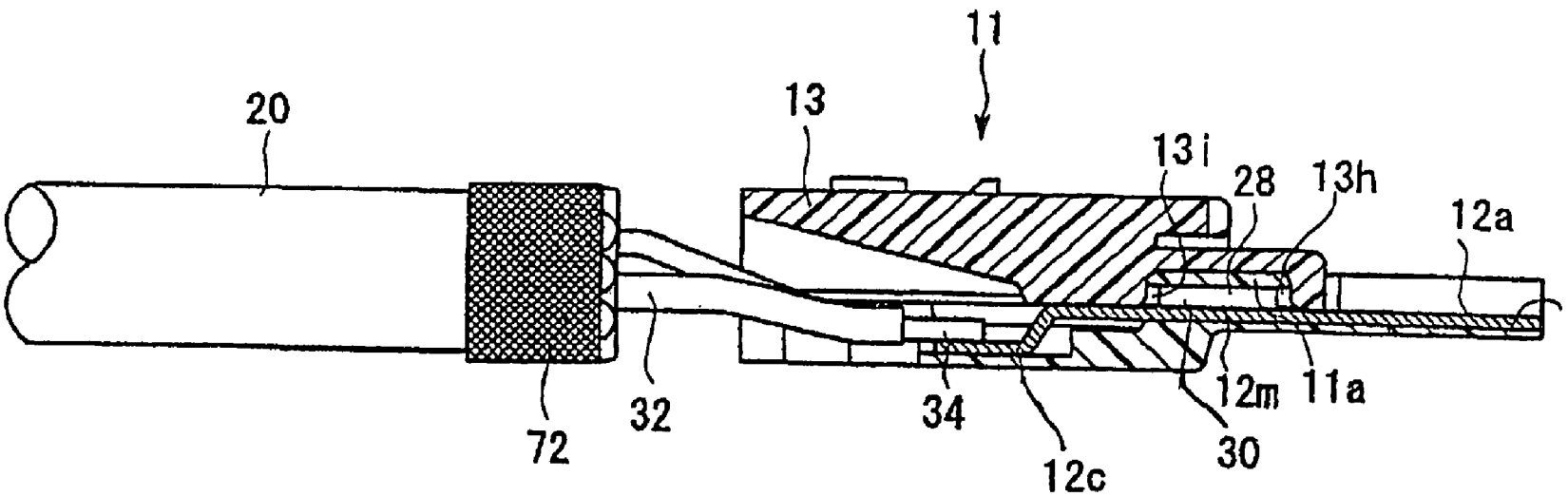
FIG. 19 is a cross sectional view showing a state in which the housing cover is mounted to the housing of FIG. 18.

As shown in FIG. 19, the housing cover 113 is then mounted to the housing 11. Next, as shown in FIG. 20, the housing 11 is inserted into the shield case 14A rearwardly in the axial direction. At this point, the wall member 114*c*1 extends from the bottom wall 14*f*, with the ceiling wall 114*c*3 extending from wall member 114*c*1 and the clamp portion 14*d* extending from ceiling wall 114*c*3. Further, the hold plate 202 is brought into a hung state at this occasion. Further, the clamp portion 14*d* is opened to this side.

Figure 21:
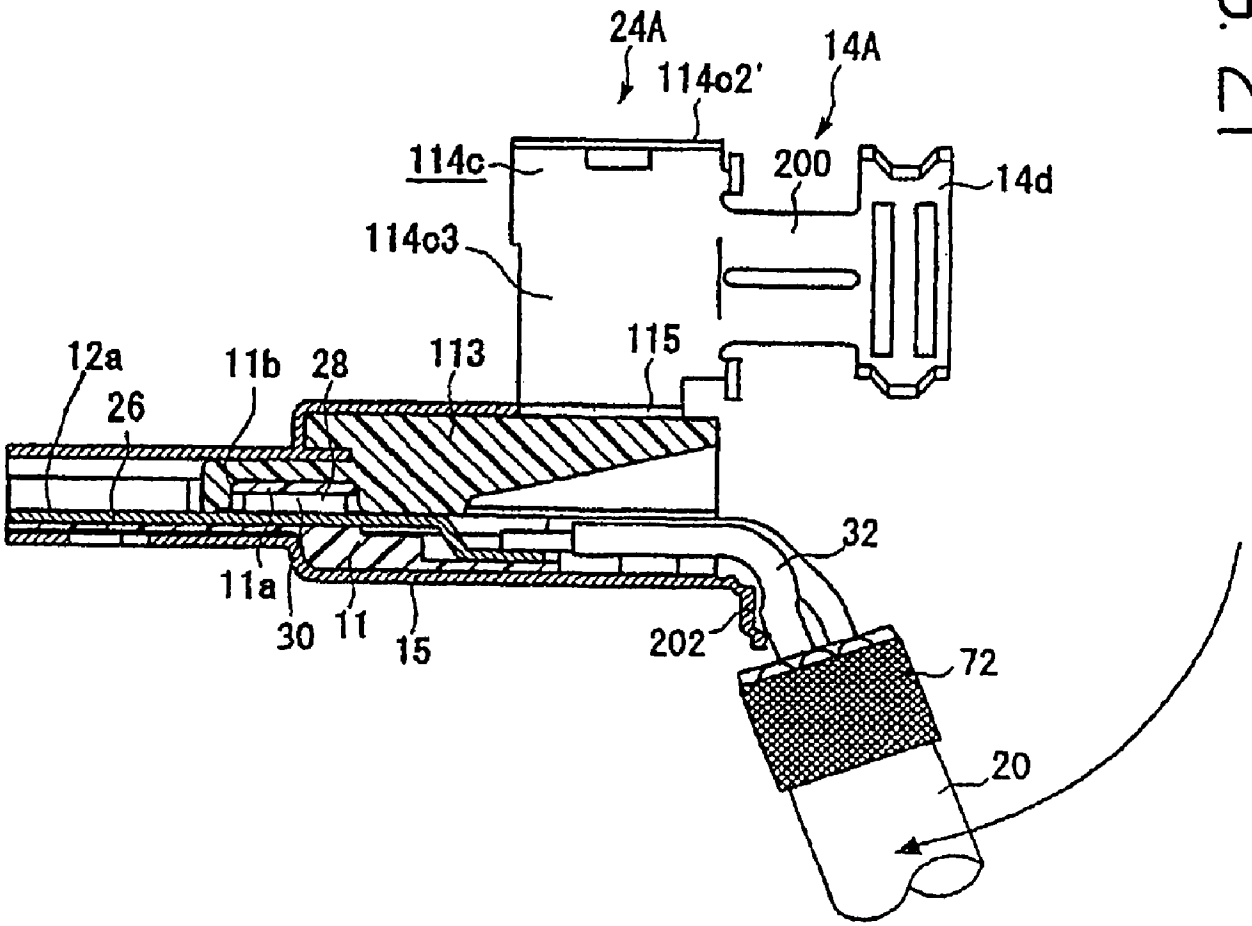
FIG. 21 is a cross sectional view showing a state in which a cable is bent in the state of FIG. 20.

As shown in FIG. 21, the cable 20 is then bent downwardly at the portion of the electric wires 32. The bending extends to the front side of the hold plate 202. The bending is for avoiding interference between the electric wires and the clamp portion 14*d*.

Figure 23:
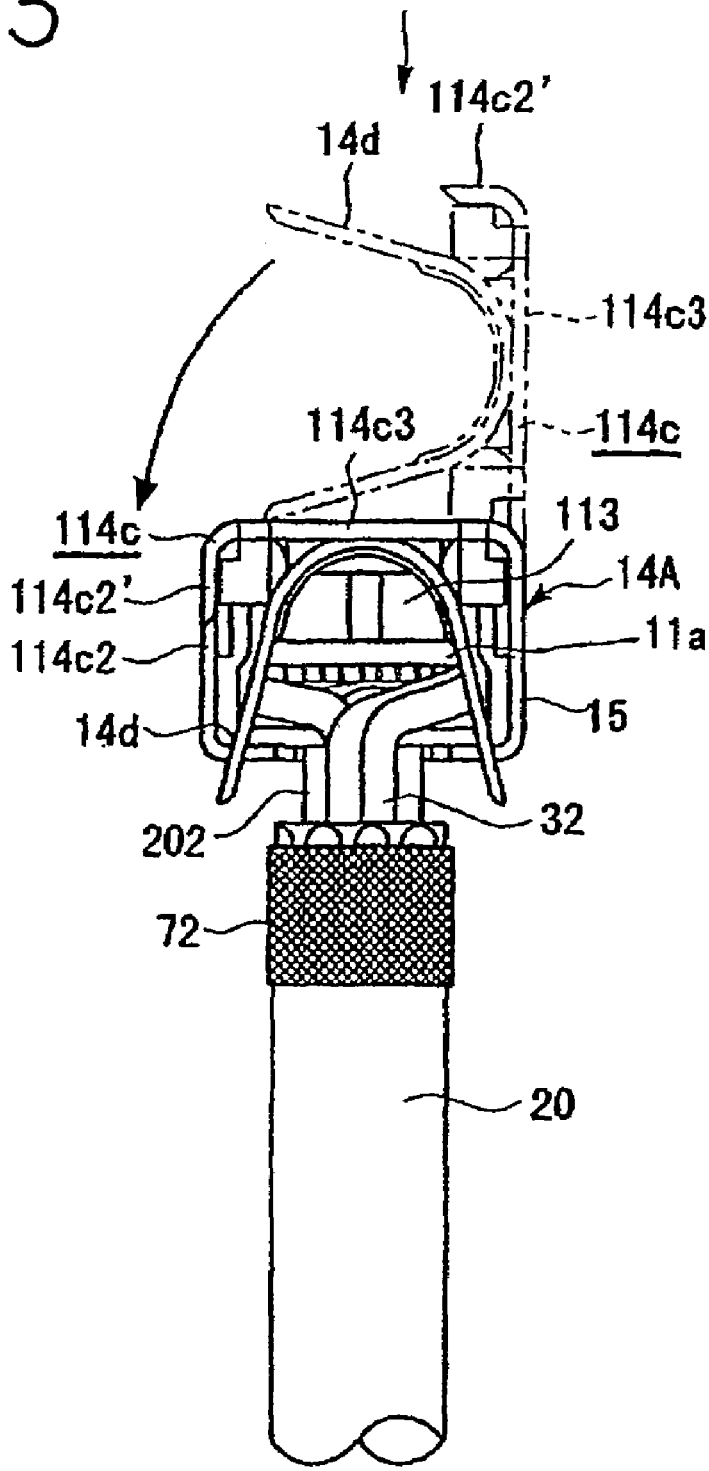
FIG. 23 is a view showing a state in which the cable extended from the housing shielded by the shield case is bent.

As shown in FIG. 23, when an external force is exerted to the ceiling wall 114*c*3 of the wall member 114*c*1 toward an inner side of the shield case 14A, stress is produced at the folding line 115 and therefore, the ceiling wall 114*c*3 is folded to bend to cover the housing cover 13 from above (see arrow mark of FIG. 23). At this occasion, the clamp portion 14*d*, which is integral with the ceiling wall 14*c*3, is pivoted together and the opening is directed downwardly as shown in FIG. 23. Once this procedure is completed, the axis line L1 and the axis line L2 overlap each other and the plug main body is disposed on the same axis core.

Figure 22:
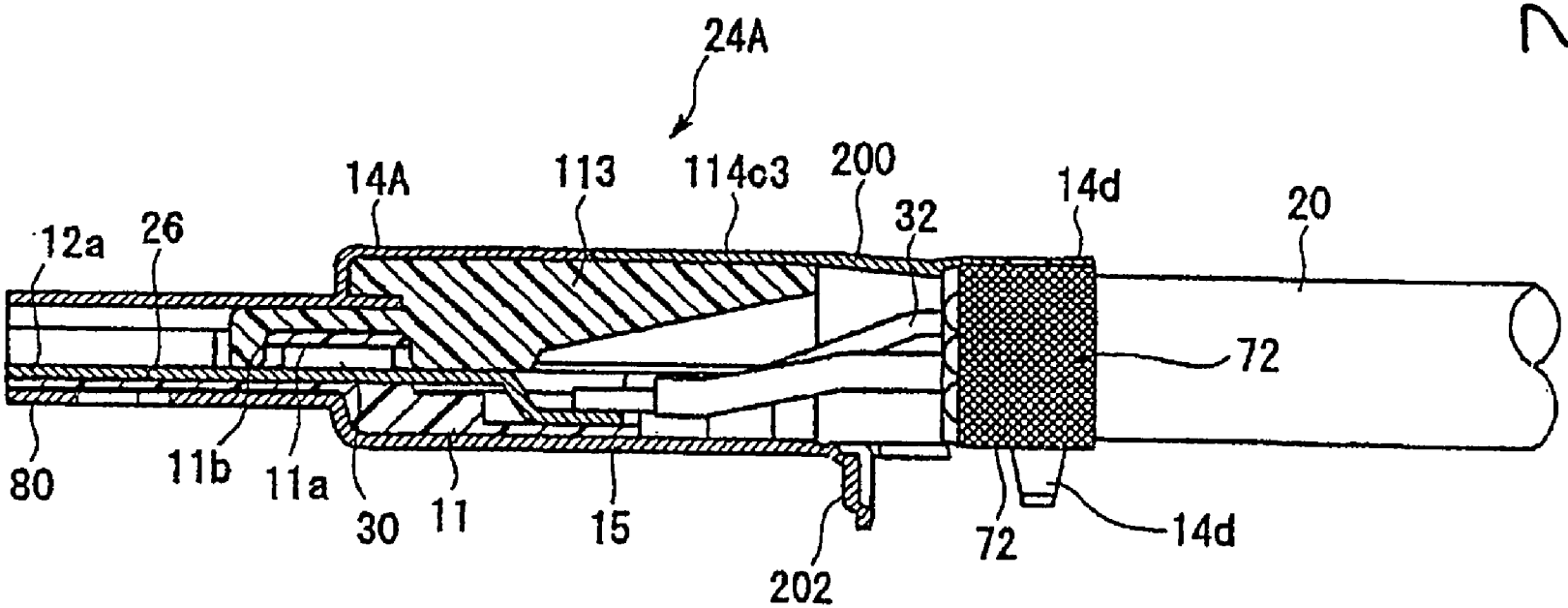
FIG. 22 is a view showing a state in which bending of the cable is recovered from the state of FIG. 21 and the housing is shielded by the shield case.

Next, the cable 20 bent in FIG. 21 is recovered to its unbent state, as shown in FIG. 22.

Figure 25:
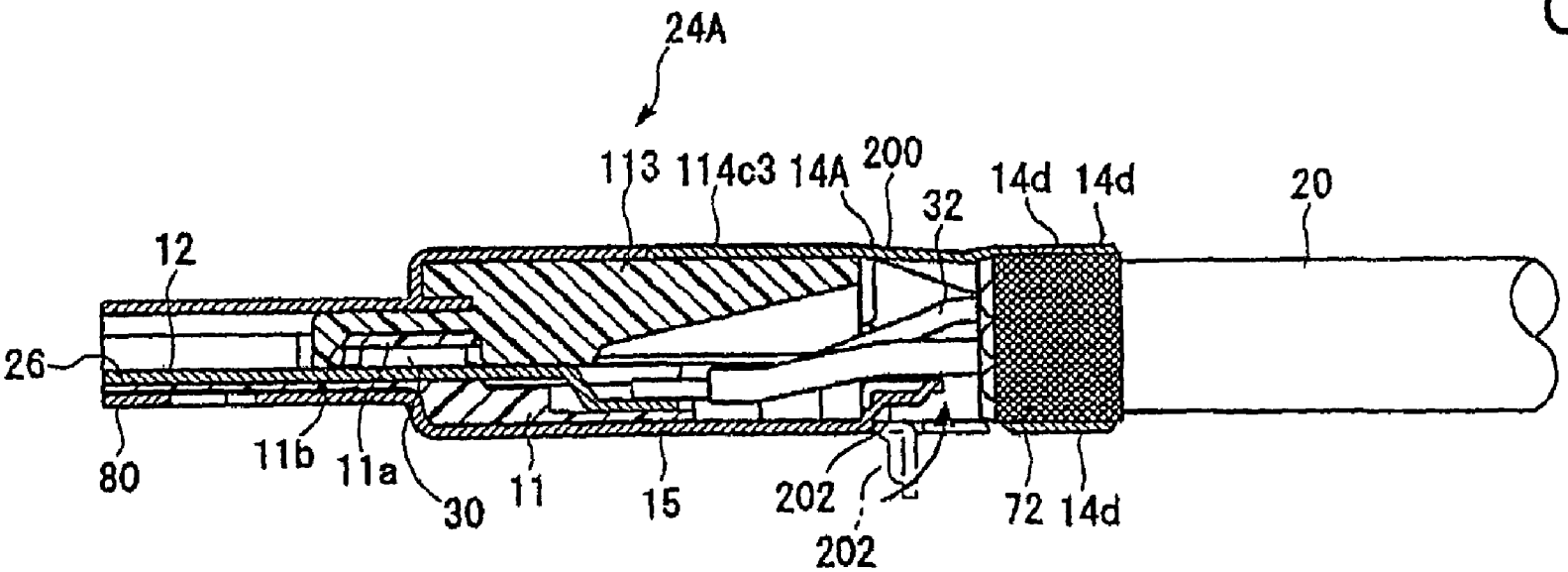
FIG. 25 is a cross sectional view showing a state of fixing electric wires in the housing.
Figure 26:
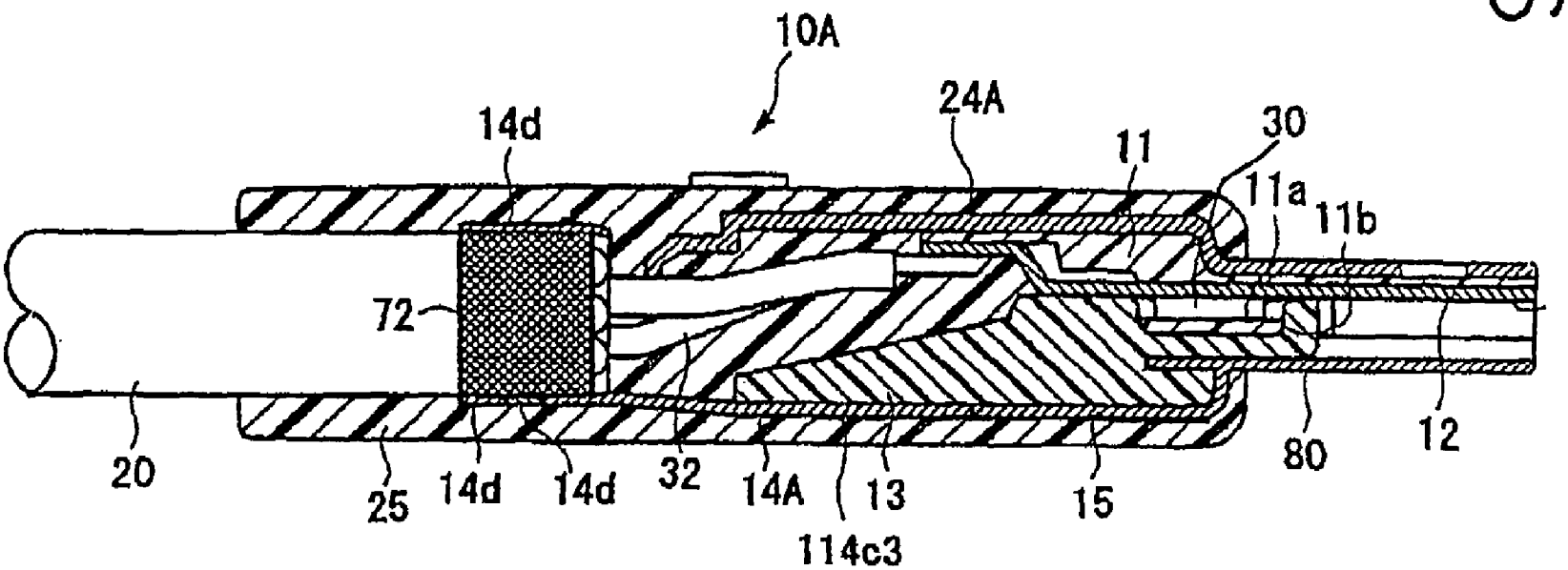
FIG. 26 is a cross sectional view shoving a plug in which a plug main body is covered by a handhold portion formed by overmolding.

As shown in FIG. 24, the copper foil portion 72 is then clamped by the clamp portion 14*d* and the cable 20 is straightly extended to the rear side in the axial direction. Next, as shown in FIG. 25, bending of the hold plate 202 is turned back and the electric wires 32 are fixed by the hold plate 202 in the housing 11. Finally, as shown in FIG. 26, there is formed the plug 10A by covering the plug main body 24A by the handhold portion 25 formed by overmolding.

According to the shield case 14A adopted in the plug 10A, the clamp portion 14*d* is disposed on the axis core L1 by being made to be eccentric from the axis core L2 of the shield case 14A and therefore, prior to integrating the plug main body 24A to the shield case 14A, the clamp portion 14*d* is not present on the same axis core. As such, the clamp portion 14*d* does not constitutes a hindrance in inserting the housing 11 into the shield case 14A. Therefore, operation of integrating the housing 11 and the shield case 14A is simplified.

Further, since the cylindrical portion 14*a* shielding by the housing 11, and the ceiling wall 114*c*3 as the cover shield portion shielding the housing cover, are integrated as a single structure, as compared to two separate shield parts, time and labor to install the shield to the plug is reduced compared to two part shield systems.

It will be understood that the invention may be embodied in other specific forms without departing from the spirit thereof. The present examples and embodiments, therefore, are to be considered in all respects as illustrative and not restrictive, and the invention is not to be limited to the details given herein.

The invention claimed is:

1. A plug connector, comprising:

a housing;

a plurality of grooves formed in an axial direction of the housing;

a plurality of terminals fitted in the grooves, the terminals being capable of being terminated to a cable;

a housing cover for covering a portion of the cable and the terminals;

an intersecting portion formed at the housing and orthogonal to the grooves; and an engaging projection formed at the housing cover for engaging with the intersecting portion in the axial direction, wherein the intersecting portion includes a rectangular bridge member extending from the housing to form a bridge over the plurality of grooves, and the engaging projection is fitted in a space formed between the plurality of grooves and the rectangular bridge member, wherein the space portion is a through hole extending through both ends of the bridge member, the through hole being open in the axial direction and wherein the engaging projection is at least a pair of projections formed at positions respectively substantially closing the openings at both ends of the bridge member.

2. The plug connector of claim 1, wherein the rectangular bridge member includes a plurality of walls partitioning the space portion in accordance with the number of the grooves; and wherein the engaging projection is a plurality of small projections respectively fitted in openings of small gaps formed by the plurality of partition walls.

3. The plug connector of claim 1, wherein the rectangular bridge member includes a plurality of walls partitioning the space portion in accordance with the number of the grooves.

4. The plug connector of claim 1, including a shield case, the shield case including a main body for shielding the housing.

5. The plug connector of claim 4, wherein the shield case includes a clamp portion provided eccentrically from the shield case main body and having a clamp portion capable of clamping a cable terminated to the terminals.

6. The plug connector of claim 1 in combination with a cable, the cable being terminated to at least one of the terminals.

* * * * *